US012529283B2

(12) United States Patent
Greci et al.

(10) Patent No.: US 12,529,283 B2
(45) Date of Patent: Jan. 20, 2026

(54) LOW-DENSITY FLOATS INCLUDING ONE OR MORE HOLLOW CERAMIC SHELLS FOR USE IN A DOWNHOLE ENVIRONMENT

(71) Applicant: Halliburton Energy Services, Inc., Houston, TX (US)

(72) Inventors: Stephen Michael Greci, Carrollton, TX (US); Ryan W. McChesney, Carrollton, TX (US); Ryan M. Novelen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/125,584

(22) Filed: Mar. 23, 2023

(65) Prior Publication Data

US 2023/0304377 A1 Sep. 28, 2023

Related U.S. Application Data

(60) Provisional application No. 63/323,691, filed on Mar. 25, 2022.

(51) Int. Cl.
*E21B 34/06* (2006.01)

(52) U.S. Cl.
CPC ..... *E21B 34/06* (2013.01)

(58) Field of Classification Search
CPC ..... E21B 34/06; E21B 43/12
See application file for complete search history.

(56) References Cited

U.S. PATENT DOCUMENTS

| | | | | |
|---|---|---|---|---|
| 6,365,268 | B1 * | 4/2002 | Williams | F16L 59/07 428/323 |
| 6,520,261 | B1 * | 2/2003 | Janoff | C08K 7/28 428/323 |
| 7,913,765 | B2 | 3/2011 | Crow et al. | |
| 10,100,622 | B2 * | 10/2018 | Gonzalez | E21B 43/12 |
| 10,214,991 | B2 * | 2/2019 | van Petegem | E21B 43/12 |
| 10,704,359 | B2 * | 7/2020 | Fripp | E21B 34/08 |
| 11,493,145 | B2 | 11/2022 | Fripp et al. | |

(Continued)

FOREIGN PATENT DOCUMENTS

| | | | |
|---|---|---|---|
| CN | 111101908 | 5/2020 | |
| WO | WO-2012152875 A1 * | 11/2012 | E21B 17/015 |

(Continued)

OTHER PUBLICATIONS

"High Performing Lightweight Hollow Shells," Trelleborg Applied Technologies, 2020, 2 pages.

*Primary Examiner* — Matthew R Buck
(74) *Attorney, Agent, or Firm* — Scott Richardson; Parker Justiss, P.C.

(57) ABSTRACT

Provided is a float for use with a fluid flow control device, a fluid flow control device, a method for manufacturing a fluid flow control device, and a well system. The float, in one aspect, includes a base material having one or more hollow ceramic shells therein, the base material and the one or more hollow ceramic shells creating a net density for the float that is between a first density of a desired fluid and a second density of an undesired fluid, such that the float may control fluid flow through a flow control device when encountering the desired fluid or the undesired fluid.

12 Claims, 22 Drawing Sheets

(56) References Cited

U.S. PATENT DOCUMENTS

| | | | | |
|---|---|---|---|---|
| 11,530,596 | B2 | 12/2022 | McChesney et al. | |
| 11,543,049 | B2 | 1/2023 | Greci et al. | |
| 2006/0076150 | A1 | 4/2006 | Coronado et al. | |
| 2016/0258242 | A1 | 9/2016 | Hayter et al. | |
| 2017/0096860 | A1 | 4/2017 | Zhou | |
| 2017/0356273 | A1 | 12/2017 | Bayh, III et al. | |
| 2020/0063518 | A1* | 2/2020 | Fripp | E21B 43/14 |
| 2020/0064871 | A1* | 2/2020 | Fripp | E21B 43/12 |
| 2020/0217174 | A1 | 7/2020 | Brandsdal | |
| 2020/0256154 | A1* | 8/2020 | Penno | E21B 43/12 |
| 2020/0291745 | A1* | 9/2020 | Greci | E21B 34/08 |
| 2020/0370382 | A1* | 11/2020 | Gohari | E21B 17/18 |
| 2022/0403714 | A1 | 12/2022 | McChesney et al. | |

FOREIGN PATENT DOCUMENTS

| | | | | |
|---|---|---|---|---|
| WO | WO-2014113058 | A2 * | 7/2014 | C22C 1/0416 |
| WO | 2017004285 | A1 | 1/2017 | |
| WO | 2020102263 | A1 | 5/2020 | |

* cited by examiner

LOW-DENSITY FLOATS INCLUDING ONE OR MORE HOLLOW CERAMIC SHELLS FOR USE IN A DOWNHOLE ENVIRONMENT

CROSS-REFERENCE TO RELATED APPLICATION

This application claims the benefit of U.S. Provisional Application Ser. No. 63/323,691, filed on Mar. 25, 2022, entitled "LOW-DENSITY FLOATS INCLUDING ONE OR MORE HOLLOW CERAMIC SHELLS FOR USE IN A DOWNHOLE ENVIRONMENT," commonly assigned with this application and incorporated herein by reference in its entirety.

BACKGROUND

Wellbores are sometimes drilled from the surface of a wellsite several hundred to several thousand feet downhole to reach hydrocarbon resources. During certain well operations, such as production operations, certain fluids, such as fluids of hydrocarbon resources, are extracted from the formation. For example, the fluids of hydrocarbon resources may flow into one or more sections of a conveyance such as a section of a production tubing, and through the production tubing, uphole to the surface. During production operations, other types of fluids, such as water, sometimes also flow into the section of production tubing while the fluids of hydrocarbon resources are being extracted.

BRIEF DESCRIPTION

Reference is now made to the following descriptions taken in conjunction with the accompanying drawings, in which.

Figure 7A:
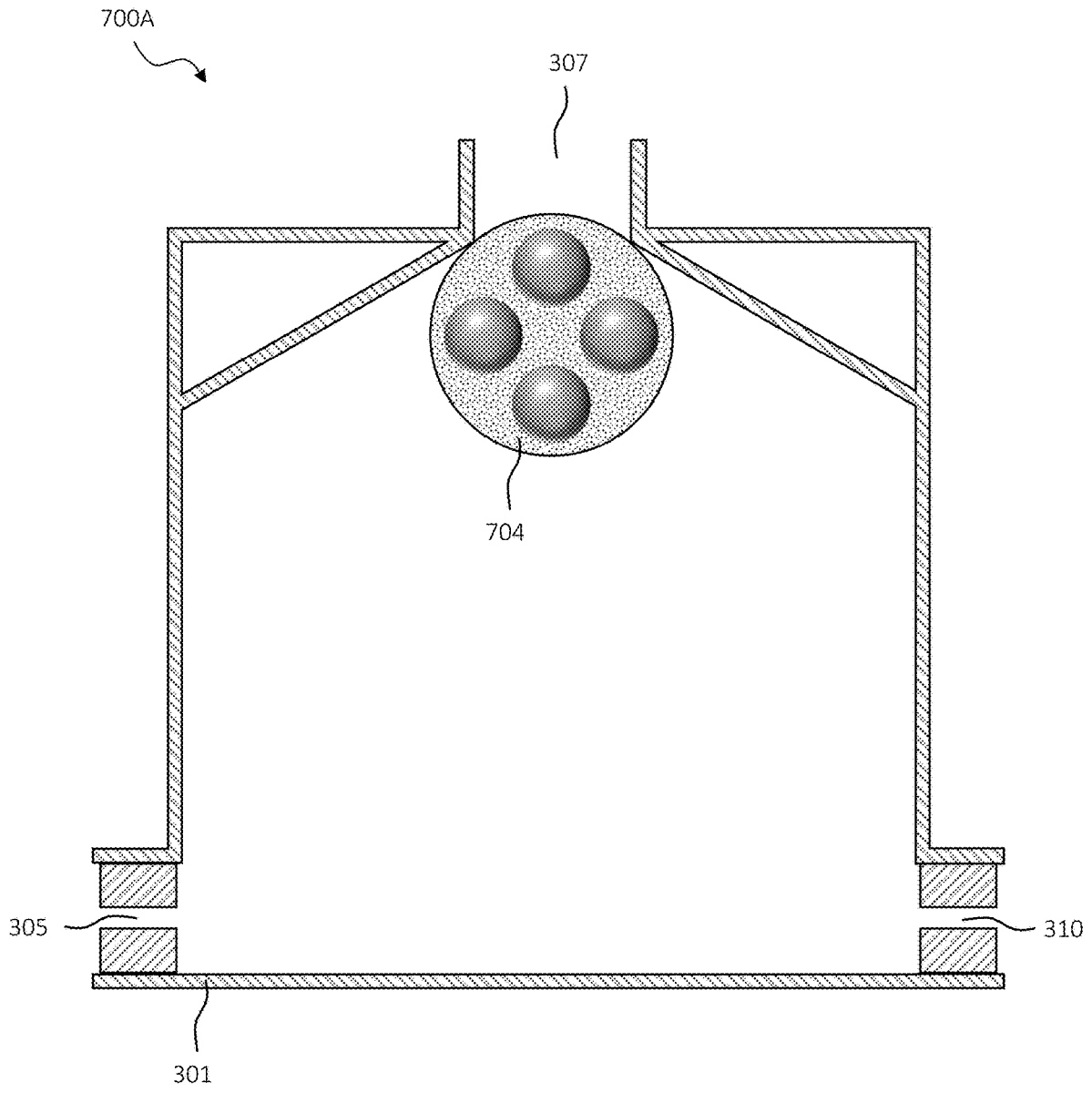
FIGS. 7A and 7B illustrates cross-sectional views of an alternative embodiment of a fluid flow control device designed, manufactured, and operated according to one or more embodiments of the disclosure.
Figure 7B:
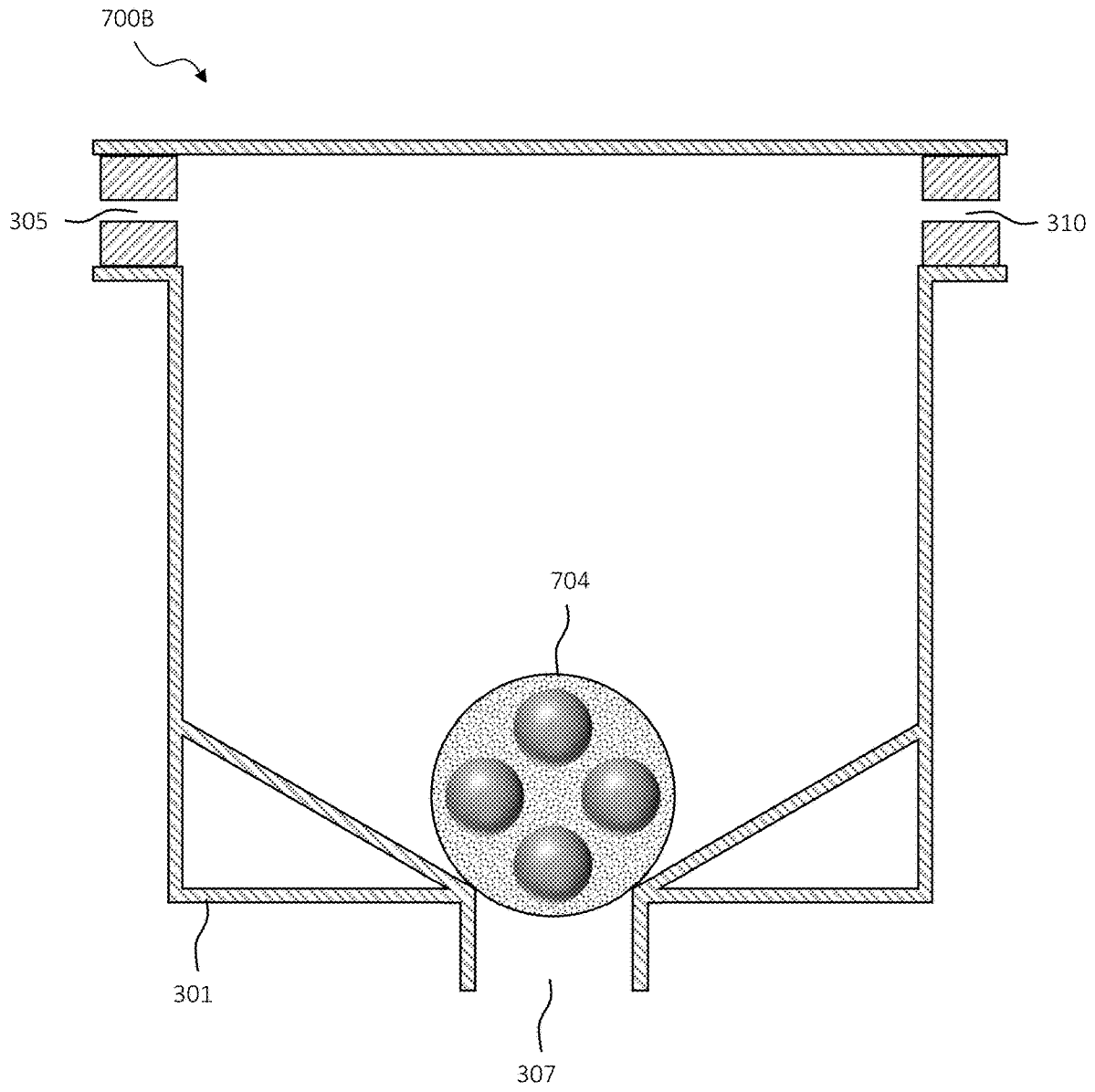
Figure 9:
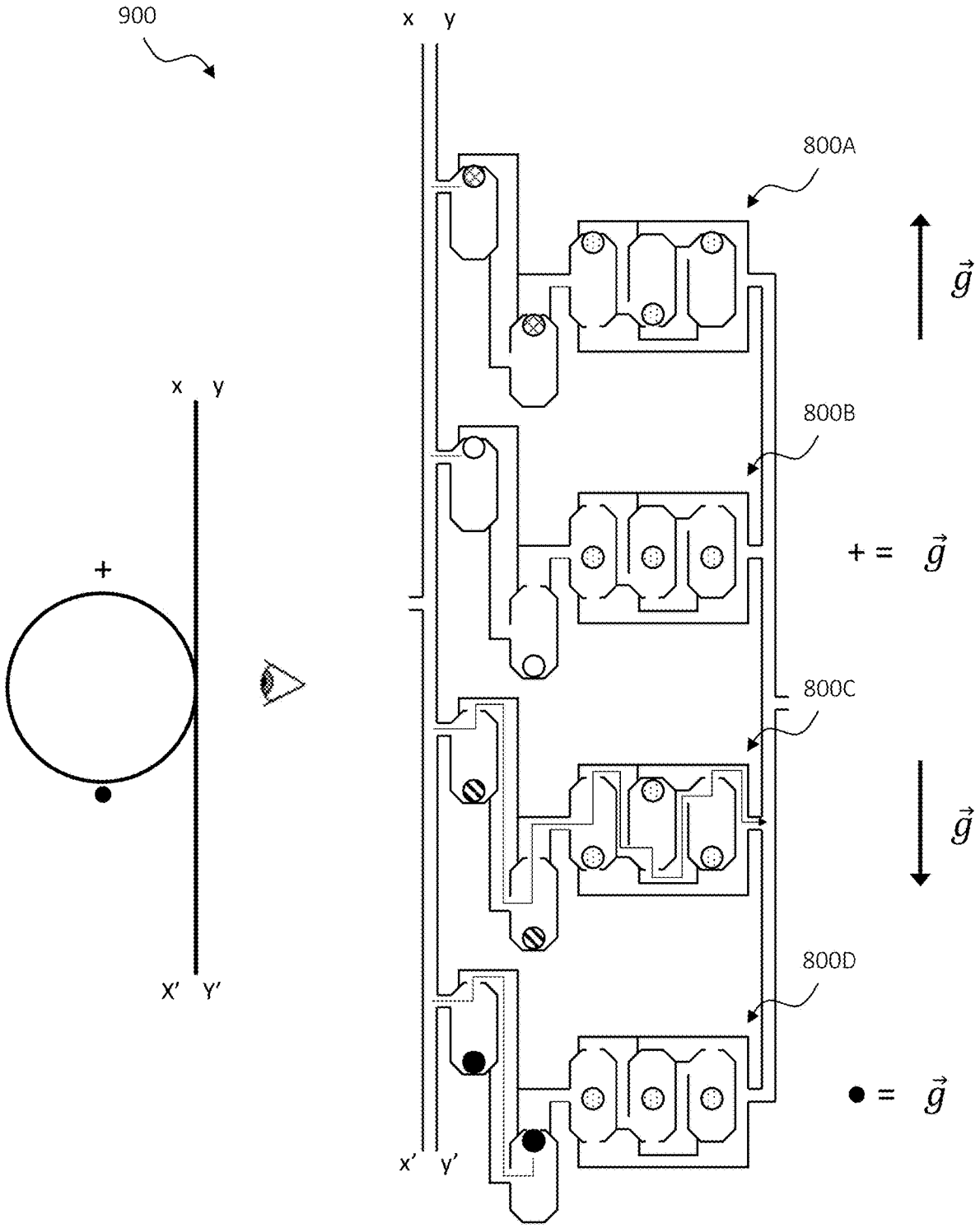

FIG. 9 illustrates a rolled-out view (360°) of a device comprising four orientation dependent inflow control apparatuses equidistantly distributed around the perimeter outside of a basepipe (not shown); and FIGS. 10A through 10F illustrate cross-sectional views of a variety of different floats (e.g., spherical shaped floats) designed, manufactured, and operated according to one or more embodiments of the disclosure, as might be used with the fluid flow control device of FIG. 7A or 7B.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

The present disclosure relates, for the most part, to fluid flow control devices and downhole floats. The fluid flow control device, in at least one embodiment, includes an inlet port and an outlet port. The fluid flow control device, in at least this embodiment, also includes a float that is positioned between the inlet port and the outlet port. The float is operable to move between an open position that permits fluid flow through the outlet port and a closed position that restricts fluid flow through the outlet port. As referred to herein, an open position is a position of the float where the float does not restrict fluid flow through the outlet port, whereas a closed position is a position of the float where the float restricts fluid flow through the outlet port. In some embodiments, the float shifts radially inwards toward the outlet port to move from an open position to a closed position, and shifts radially outwards away from the outlet port to move from the closed position to the open position. In some embodiments, the float shifts radially outwards toward the outlet port to move from an open position to a closed position, and shifts radially inward away from the outlet port to move from the closed position to the open position. In some other embodiments, the float is hinged such that as the body of float shifts radially outward another portion of the float shifts radially inward, whether to open or close the outlet port. As referred to herein, radially inwards means shifting radially towards the center, such as the central axis, whereas radially outwards means shifting away from the center, such as away from the central axis.

In some embodiments, the float shifts circumferentially (such as circumferentially about a flow pathway of a port) from a first position to a second position to move from an open position to a closed position, and shifts from the second position to the first position to move from the closed position to the open position. In some embodiments, the float shifts linearly from a first position to a second position to move from an open position to a closed position, and shifts linearly from the second position to the first position to move from the closed position to the open position. In yet another embodiment, the float is contained within an enclosure of fluid that it is able to freely move within, the float operable to float from a first position to a second position to move from an open position to a closed position, and sink from the second position to the first position to move from the closed position to the open position. In some embodiments, the float opens to permit certain types of fluids having densities that are less than a threshold density (such as oil and other types of hydrocarbon resources) to flow through the outlet port, and restricts other types of fluids having densities greater than or equal to the threshold density (such as water and drilling fluids) from flowing through the outlet port.

The present disclosure is based, at least in part, on the acknowledgment that there is a need for low density floats for use in downhole environments. The present disclosure has further acknowledged that such downhole environments see extreme hydrostatic pressures, high temperatures, a variety of harsh chemicals, and typically require a long service life, and that there is not a good solution for downhole components with a density lower than 1.3 specific gravity (sg). Based, at least in part on the foregoing acknowledgements, the present disclosure has recognized for the first time that a solution to the forgoing is manufacturing downhole floats including one or more hollow ceramic shells. In at least one embodiment, the one or more hollow ceramic shells are hollow alumina ceramic shells. The number of the shells, size of the shells, material of the shells, and wall thickness of the shells, along with any material that the one or more hollow ceramic shells may be embedded or enclosed within, may be tailor to reduce the net density of the part, while providing strength to the part to handle the extreme hydrostatic pressures, temperatures and environment.

In at least one embodiment, the floats include a base material and one or more hollow ceramic shells. and may be used with density autonomous inflow control devices (ICDs). Often, there is a need for the float's density to be between that of oil and water (e.g., 0.75 sg and 1.0 sg, respectively) or between gas and liquids (e.g., 0.1 sg and 0.75 sg, respectively). By employing the one or more hollow ceramic shells, these floats can obtain a net density in this range, while using a base material with a native density higher than that of water, and in certain embodiments a native density of at least 1.3 sg. This also allows quick customization of the parts shape, density, and its center of gravity location.

While the above example has been discussed generally with regard to a ceramic material, certain ceramic materials have particular value. For instance, the ceramic material could include alumina, porcelain, cordierite, yttrium stabilized zirconium, yttrium oxide, boron carbide, silicon carbide, aluminosilicate, among others.

In certain embodiments, the float including the one or more hollow ceramic shells includes a fluid impermeable exterior. In yet another embodiment, the fluid impermeable exterior forms a hermetic seal around the one or more hollow ceramic shells.

Ultimately, the floats are designed to sink and float in a variety of downhole fluids such as: gas, oil, water/brine, and mud. The floats may be used to block or unblock flow paths in downhole flow control devices. The floats can be free floating, hinged, sliding, or any other mechanism that uses their buoyancy or a combination of buoyancy and mechanical advantage to open or close a flow path.

Figure 1:
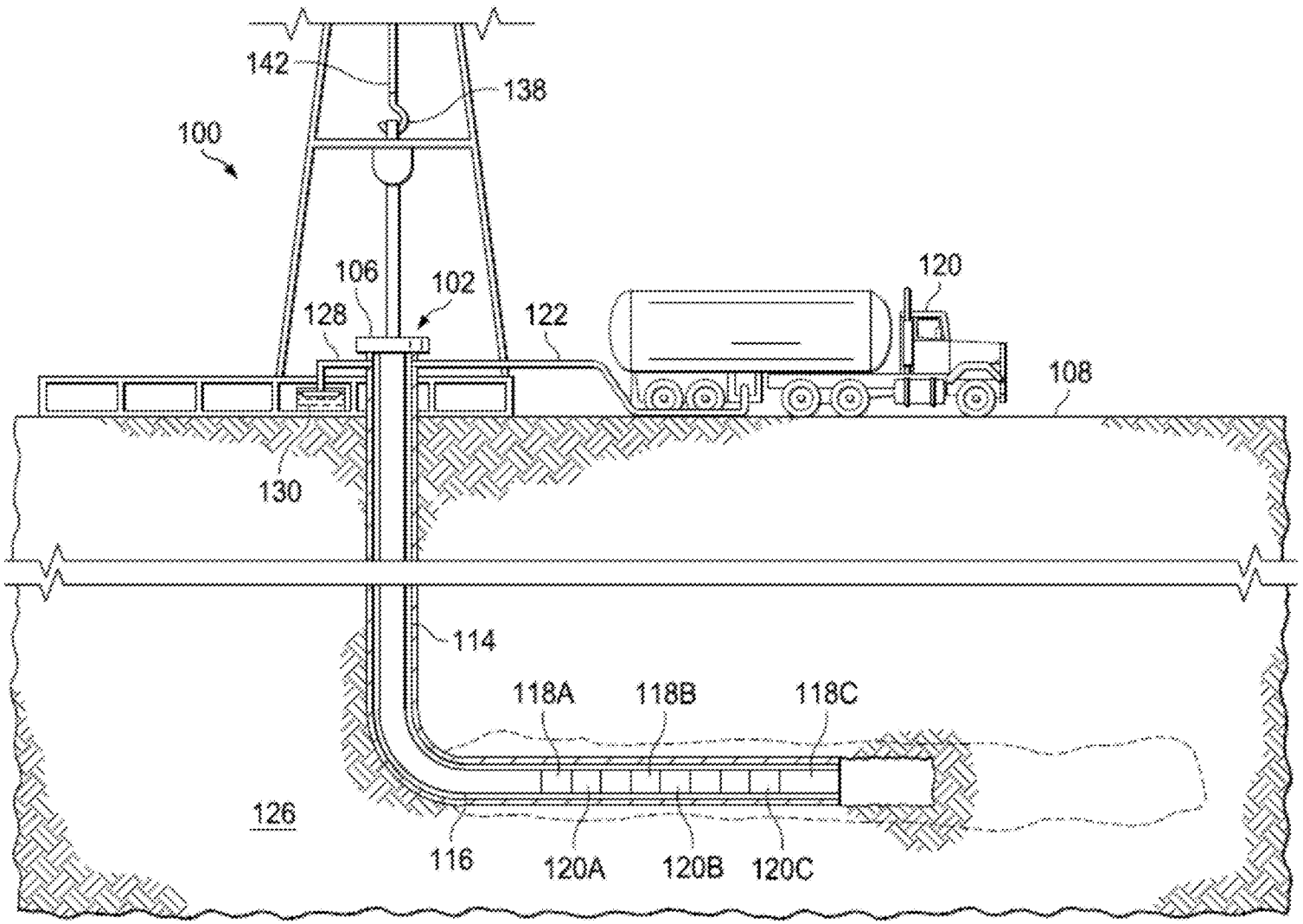
FIG. 1 illustrates a schematic, side view of a well system in which inflow control devices are deployed in a wellbore.

Turning now to the figures, FIG. 1 illustrates a schematic side view of a well system 100 in which inflow control devices 120A-120C are deployed in a wellbore 114. As shown in FIG. 1, wellbore 114 extends from surface 108 of well 102 to or through formation 126. A hook 138, a cable 142, traveling block (not shown), and hoist (not shown) may be provided to lower conveyance 116 into well 102. As referred to herein, conveyance 116 is any piping, tubular, or fluid conduit including, but not limited to, drill pipe, production tubing, casing, coiled tubing, and any combination thereof. Conveyance 116 provides a conduit for fluids extracted from formation 126 to travel to surface 108. In some embodiments, conveyance 116 additionally provides a conduit for fluids to be conveyed downhole and injected into formation 126, such as in an injection operation. In some embodiments, conveyance 116 is coupled to a production tubing that is arranged within a horizontal section of well 102. In the embodiment of FIG. 1, conveyance 116 and the production tubing are represented by the same tubing.

At wellhead 106, an inlet conduit 122 is coupled to a fluid source 120 to provide fluids through conveyance 116 downhole. For example, drilling fluids, fracturing fluids, and injection fluids are pumped downhole during drilling operations, hydraulic fracturing operations, and injection operations, respectively. In the embodiment of FIG. 1, fluids are circulated into well 102 through conveyance 116 and back toward surface 108. To that end, a diverter or an outlet conduit 128 may be connected to a container 130 at the wellhead 106 to provide a fluid return flow path from wellbore 114. Conveyance 116 and outlet conduit 128 also form fluid passageways for fluids, such as hydrocarbon resources to flow uphole during production operations.

In the embodiment of FIG. 1, conveyance 116 includes production tubular sections 118A-118C at different production intervals adjacent to formation 126. In some embodiments, packers (now shown) are positioned on the left and right sides of production tubular sections 118A-118C to define production intervals and provide fluid seals between the respective production tubular section 118A, 118B, or 118C, and the wall of wellbore 114. Production tubular sections 118A-118C include inflow control devices 120A-120C (ICDs). An inflow control device controls the volume or composition of the fluid flowing from a production interval into a production tubular section, e.g., 118A. For example, a production interval defined by production tubular section 118A produces more than one type of fluid component, such as a mixture of oil, water, steam, carbon dioxide, and natural gas. Inflow control device 120A, which is fluidly coupled to production tubular section 118A, reduces or restricts the flow of fluid into the production tubular section 118A when the production interval is producing a higher proportion of an undesirable fluid component, such as water, which permits the other production intervals that are producing a higher proportion of a desired fluid component (e.g., oil) to contribute more to the production fluid at surface 108 of well 102, so that the production fluid has a higher proportion of the desired fluid component. In some embodiments, inflow control devices 120A-120C are an autonomous inflow control devices (AICD) that permits or restricts fluid flow into the production tubular sections 118A-118C based on fluid density, without requiring signals from the well's surface by the well operator.

Although the foregoing paragraphs describe utilizing inflow control devices 120A-120C during production, in some embodiments, inflow control devices 120A-120C are also utilized during other types of well operations to control fluid flow through conveyance 116. Further, although FIG. 1 depicts each production tubular section 118A-118C having an inflow control device 120A-120C, in some embodiments, not every production tubular section 118A-118C has an inflow control device 120A-120C. In some embodiments, production tubular sections 118A-118C (and inflow control devices 120A-120C) are located in a substantially vertical section additionally or alternatively to the substantially horizontal section of well 102. Further, any number of production tubular sections 118A-118C with inflow control devices 120A-120C, including one, are deployable in the well 102. In some embodiments, production tubular sections 118A-118C with inflow control devices 120A-120C are disposed in simpler wellbores, such as wellbores having only a substantially vertical section. In some embodiments, inflow control devices 120A-120C are disposed in cased wells or in open-hole environments.

In at least one embodiment, one or more of the inflow control devices 120A-120C include one or more floats designed, manufactured, and operated according to the disclosure. In accordance with at least one embodiment, the one or more floats include one or more hollow ceramic shells, the one or more hollow ceramic shells creating a net density for the float that is between a first density of a desired fluid and a second density of an undesired fluid. Accordingly, the one or more floats may control fluid flow through a flow control device when encountering the desired fluid or the undesired fluid. The one or more floats may additionally include a fluid impermeable exterior surrounding the one or more hollow ceramic shells. The phrase "fluid impermeable," as used herein, is intended to mean that the permeability of the exterior is less than 0.1 millidarcy. In at least one other embodiment, at least a portion of the float including the one or more hollow ceramic shells is formed using an additive manufacturing process. The phrase "additive manufacturing process," as used herein, is intended to encompass all processes in which material is deposited, joined, or solidified under computer control to create a three-dimensional object, with material being added together (such as plastics, liquids or powder grains being fused together), typically layer by layer.

Figure 2:
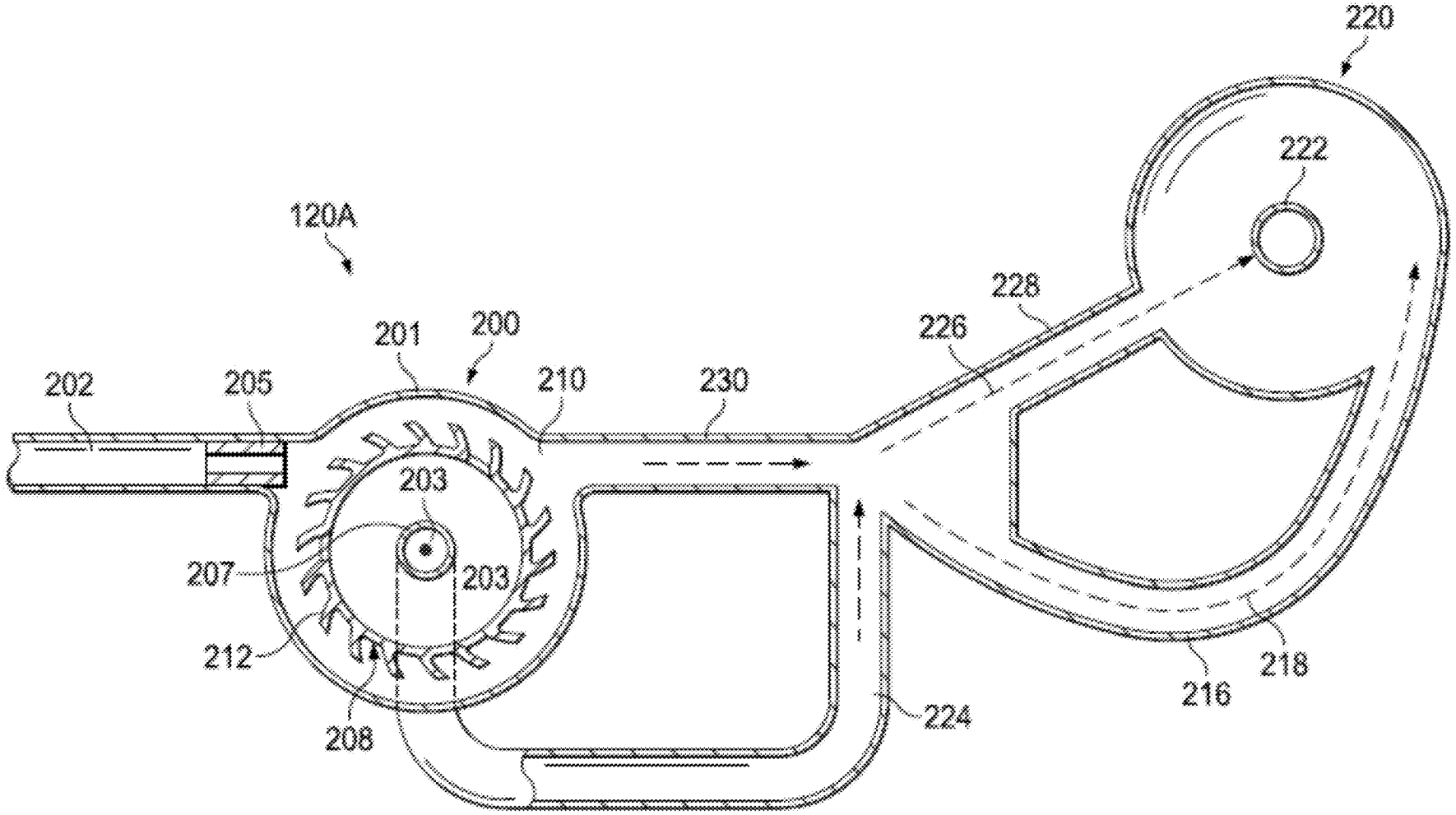
FIG. 2 illustrates a cross-sectional view of one embodiment of an inflow control device of FIG. 1.

FIG. 2 illustrates a cross-sectional view of one embodiment of an inflow control device 120A of FIG. 1. In the embodiments described in FIG. 2, inflow control device 120A includes an inflow tubular 200 of a well tool coupled to a fluid flow control device 202. Although the word "tubular" is used to refer to certain components in the present disclosure, those components have any suitable shape, including a non-tubular shape. Inflow tubular 200 provides fluid to fluid flow control device 202. In some embodiments, fluid is provided from a production interval in a well system or from another location. In the embodiment of FIG. 2, inflow tubular 200 terminates at an inlet port 205 that provides a fluid communication pathway into fluid flow control device 202. In some embodiments, inlet port 205 is an opening in a housing 201 of fluid flow control device 202.

A first fluid portion flows from inlet port 205 toward a bypass port 210. The first fluid portion pushes against fins 212 extending outwardly from a rotatable component 208 to rotate rotatable component 208 about an axis, such as a central axis 203. Rotation of rotatable component 208 about axis 203 generates a force on a float positioned within rotatable component 208. After passing by rotatable component 208, the first fluid portion exits fluid flow control device 202 via bypass port 210. From bypass port 210, the first fluid portion flows through a bypass tubular 230 to a tangential tubular 216. The first fluid portion flows through tangential tubular 216, as shown by dashed arrow 218, into a vortex valve 220. In the embodiment of FIG. 2, the first fluid portion spins around an outer perimeter of vortex valve 220 at least partially due to the angle at which the first fluid portion enters vortex valve 220. Forces act on the first fluid portion, eventually causing the first fluid portion to flow into a central port 222 of vortex valve 220. The first fluid portion then flows from central port 222 elsewhere, such as to a well surface as production fluid.

At the same time, a second fluid portion from inlet port 205 flows into rotatable component 208 via holes in rotatable component 208 (e.g., holes between fins 212 of rotatable component 208). If the density of the second fluid portion is high, the float moves to a closed position, which prevents the second fluid portion from flowing to an outlet port 207, and instead cause the second fluid portion to flow out bypass port 210. If the density of the second fluid portion is low (e.g., if the second fluid portion is mostly oil or gas), then the float moves to an open position that allows the second fluid portion to flow out the outlet port 207 and into a control tubular 224. In this manner, fluid flow control device 202 autonomously directs fluids through different pathways based on the densities of the fluids. The control tubular 224 directs the second fluid portion, along with the first fluid portion, toward central port 222 of vortex valve 220 via a more direct fluid pathway, as shown by dashed arrow 226 and defined by tubular 228. The more direct fluid pathway to central port 222 allows the second fluid portion to flow into central port 222 more directly, without first spinning around the outer perimeter of vortex valve 220. If the bulk of the fluid enters vortex valve 220 along the pathway defined by dashed arrow 218, then the fluid will tend to spin before exiting through central port 222 and will have a high fluid resistance. If the bulk of the fluid enters vortex valve 220 along the pathway defined by dashed arrow 226, then the fluid will tend to exit through central port 222 without spinning and will have minimal flow resistance.

In some embodiments, the above-mentioned concepts are enhanced by the rotation of rotatable component 208. Typically, the buoyancy force generated by the float is small because the difference in density between the lower-density fluid and the higher-density fluid is generally small, and there is only a small amount (e.g., 5 milli-Newtons) of gravitational force acting on this difference in density. This makes fluid flow control device 202 sensitive to orientation, which causes the float to get stuck in the open position or the closed position. However, rotation of rotatable component 208 creates a force (e.g., a centripetal force or a centrifugal force) on the float. The force acts as artificial gravity that is much higher than the small gravitational force naturally acting on the difference in density. This allows fluid flow control device 202 to more reliably toggle between the open and closed positions based on the density of the fluid. This also makes fluid flow control device 202 perform in a manner that is insensitive to orientation, because the force generated by rotatable component 208 is much larger than the naturally occurring gravitational force.

In some embodiments, fluid flow control device 202 directs a fluid along the more direct pathway shown by dashed arrow 226 or along the tangential pathway shown by dashed arrow 218. In one or more of such embodiments, whether fluid flow control device 202 directs the fluid along the pathway shown by dashed arrow 226 or the dashed arrow 218 depends on the composition of the fluid. Directing the fluid in this manner causes the fluid resistance in vortex valve 220 to change based on the composition of the fluid.

In some embodiments, fluid flow control device 202 is compatible with any type of valve. For example, although FIG. 2 includes a vortex valve 220, in other embodiments, vortex valve 220 is replaced with other types of fluidic valves, including valves that have a moveable valve-element, such as a rate-controlled production valve. Further, in some embodiments, fluid control device 202 operates as a pressure sensing module in a valve.

Figure 3:
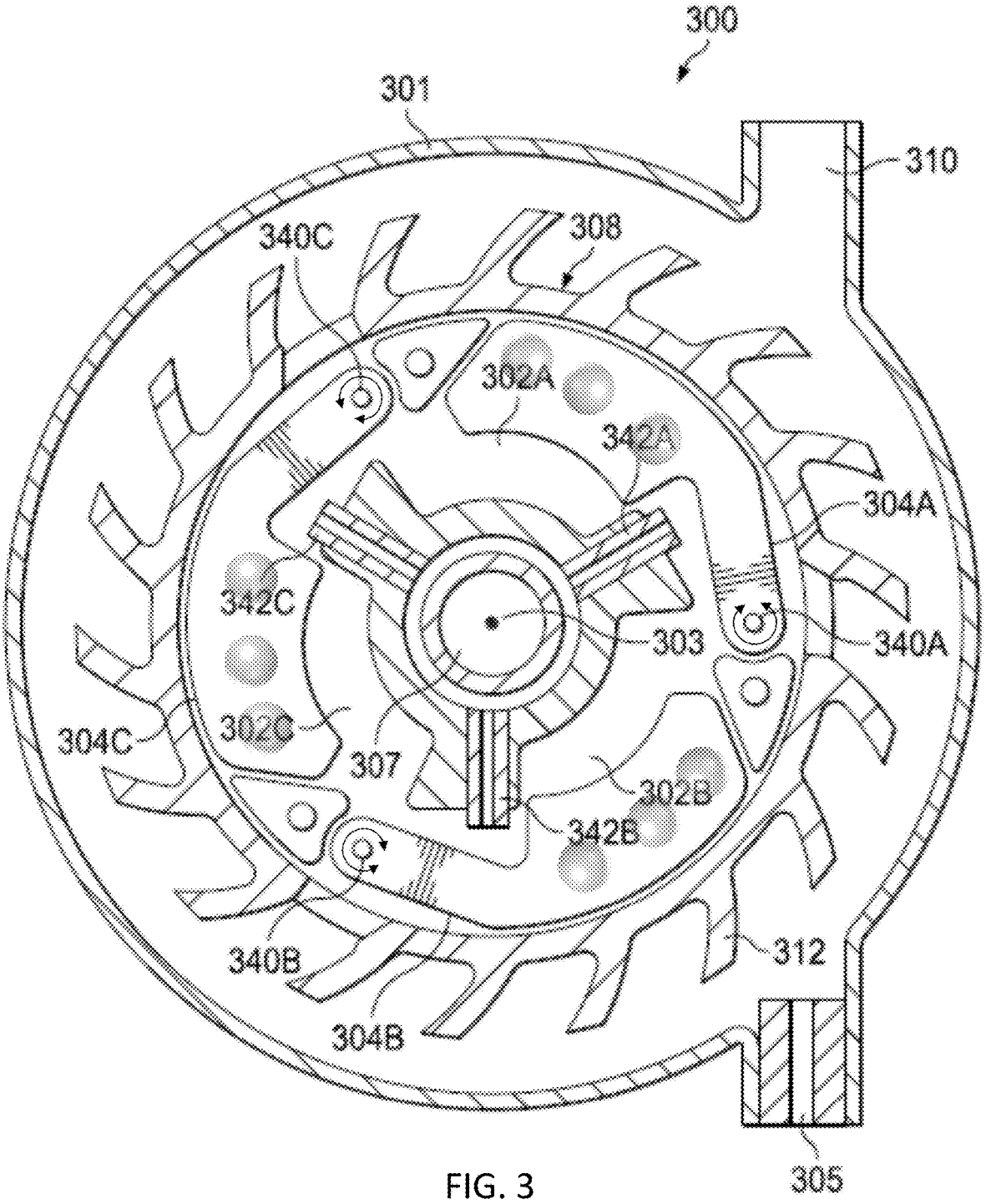
FIG. 3 illustrates a cross-sectional view of a fluid flow control device similar in certain embodiments to fluid flow control device of FIG. 2.

FIG. 3 is a cross-sectional view of a fluid flow control device 300 similar in certain embodiments to fluid flow control device 200 of FIG. 2. With reference now to FIG. 3, fluid flow control device 300 includes a rotatable component 308 positioned within a housing 301 of fluid flow control device 300. Fluid flow control device 300 also includes an inlet port 305 that provides a fluid passage for fluids such as, but not limited to, hydrocarbon resources, wellbore fluids, water, and other types of fluids to flow into housing 301. Fluid control device 300 also includes an outlet port 310 that provides a fluid flow path for fluids to flow out of fluid flow control device 300, such as to vortex valve 220 of FIG. 2. Some of the fluids that flow into housing 301 also come into contact with rotatable component 308, where force generated by fluids flowing onto rotatable component 308 rotates rotatable component 308 about axis 303. In some embodiments, fluids flowing through inlet port 305 push against fins, including fin 312, which are coupled to rotatable component 308, where the force of the fluids against the fins rotates rotatable component 308 about axis 303. Three floats 304A-304C are positioned within the rotatable component 308 and are connected to the rotatable component 308 by hinges 340A-340C, respectively, where each hinge 340A, 340B, and 340C provides for movement of a respective float 304A, 304B, and 304C relative to rotatable component 308 between the open and closed positions. In some embodiments, movements of each float 304A, 304B, and 304C between the open and the closed positions are based on fluid densities of fluids in rotatable component 308.

In some embodiments, movement of floats 304A-304C back and forth between the open and closed positions is accomplished by hinging each respective float 304A, 304B, or 304C on its hinge 340A, 340B, or 340C. In some embodiments, each hinge 340A, 340B, and 340C includes a pivot rod (not shown) mounted to rotatable component 308 and passing at least partially through float 304A, 304B, and 304C, respectively. In some embodiments, in lieu of the pivot rod mounted to rotatable component 308, each float 304A, 304B, and 304C has bump extensions that fit into recesses of rotatable component 308 for use as a hinge. In some embodiments, floats 304A-304C are configured to move back and forth from the open and closed positions in response to changes in the average density of fluids, including mixtures of water, hydrocarbon gas, and/or hydrocarbon liquids, introduced at inlet port 305. For example, floats 304A-304C are movable from the open position to the closed position in response to the fluid from inlet port 305 being predominantly water or mud, wherein the float component is movable from the closed position to the open position in response to the fluid from the inlet port 305 being predominantly a hydrocarbon, such as oil or gas.

In the embodiment of FIG. 3, rotatable component 308 includes three fluid pathways 342A-342C that provide fluid communication between inlet port 305 and an outlet port 307. Further, each fluid pathway 342A, 342B, and 342C is fluidly connected to a chamber 302A, 302B, and 302C, respectively. Moreover, each float 304A, 304B, and 304C is disposed in a chamber 302A, 302B, and 302C, respectively, such that shifting a float 304A, 304B, or 304C from an open position to a closed position restricts fluid flow through a corresponding fluid pathway 342A, 342B, or 342C, respectively, whereas shifting float 304A, 304B, or 304C from the closed position to the open position permits fluid flow through corresponding fluid pathway 342A, 342B, or 342C. In some embodiments, float 304A, 304B, or 304C permits or restricts fluid flow through fluid pathway 342A, 342B, or 342C, respectively, based on the density of the fluid in chamber 302A, 302B, or 302C, respectively. Although FIG. 3 illustrates three floats 304A-304C positioned in three chambers 302A-202C, respectively, in some embodiments, a different number of floats positioned in a different number of chambers are placed in rotatable component 308. Further, although FIG. 3 illustrates three fluid pathways 342A-342C, in some embodiments, rotatable component 308 includes a different number of fluid pathways that fluidly connect inlet port 305 to outlet port 307. Further, although FIG. 3 illustrates three floats 304A-304C positioned in three chambers 302A-202C, respectively, in some embodiments, a different number of floats positioned in a different number of chambers are placed in rotatable component 308. Further, although FIG. 3 illustrates three fluid pathways 342A-342C, in some embodiments, rotatable component 308 includes a different number of fluid pathways that fluidly connect inlet port 305 to outlet port 307.

In the illustrated embodiment, the one or more of the floats 304A-304C each comprise one or more hollow ceramic shells, the one or more hollow ceramic shells creating a net density for the float that is between a first density of a desired fluid and a second density of an undesired fluid. For example, using the one or more hollow ceramic shells, the net density of the floats 304A-304C may be specifically tailored, for example to a net specific gravity value between oil and water. Moreover, the net density may be tailored, while using materials with a native density greater than both oil and water, for example using materials with a native density of at least 1.3 sg.

FIGS. 4A through 4J illustrate cross-sectional views of a variety of different floats (e.g., paddled shaped floats) 404A-404J designed, manufactured, and operated according to one or more embodiments of the disclosure, as might be used with the fluid flow control device 300 of FIG. 3. For example, each of the floats 404A-404J could be configured to move back and forth between the open and closed positions by rotating about a hinge point.

Each of the different floats 404A-404J, or at least a portion of each of the different floats 404A-404N, includes a one or more hollow ceramic shells encapsulated within or enclosed within a base material (e.g., a polymer product such as Polyether ether ketone (PEEK)). Specifically, the one or more hollow ceramic shells, and in certain embodiments in addition to the base material, have been employed to provide a float 404A-404J having a highly specific net density (e.g., combined density of all the associated parts of the float). In at least one embodiment, the float has a net density that is above a first density of a desired fluid and below a second density of an undesired fluid. In another embodiment, the float has a net density that is above a first density of an undesired fluid and below a second density of a desired fluid. In at least one other embodiment, the native density of the base material and/or the fluid impermeable exterior is greater than the first density or the second density. For example, the native density of the base material and/or the fluid impermeable exterior may be 1.3 sg or greater.

The number of the shells, size of the shells, material of the shells, and wall thickness of the shells, along with any material that the one or more hollow ceramic shells may be embedded or enclosed within, may be tailor to reduce the net density of the part, while providing strength to the part to handle the extreme hydrostatic pressures, temperatures and environment. In at least one embodiment, the shells may have a rough or smooth surface finish, may be suitable for use at high temperatures, for example up to 1600 degrees C., may have a hydrostatic crush strength over 20 KSI, may be lightweight, may be ductile, etc. In at least one other embodiment, the shells may have a wide range of shapes, include spheres, oblate spheroids, right circular cylinders, right rectangular cylinders, right triangular cylinders, triangular prisms, cones, etc. Additionally, the shells may have a wide range of sizes, for example ranging from 0.5 mm to 20 mm, and above.

Figure 4A:
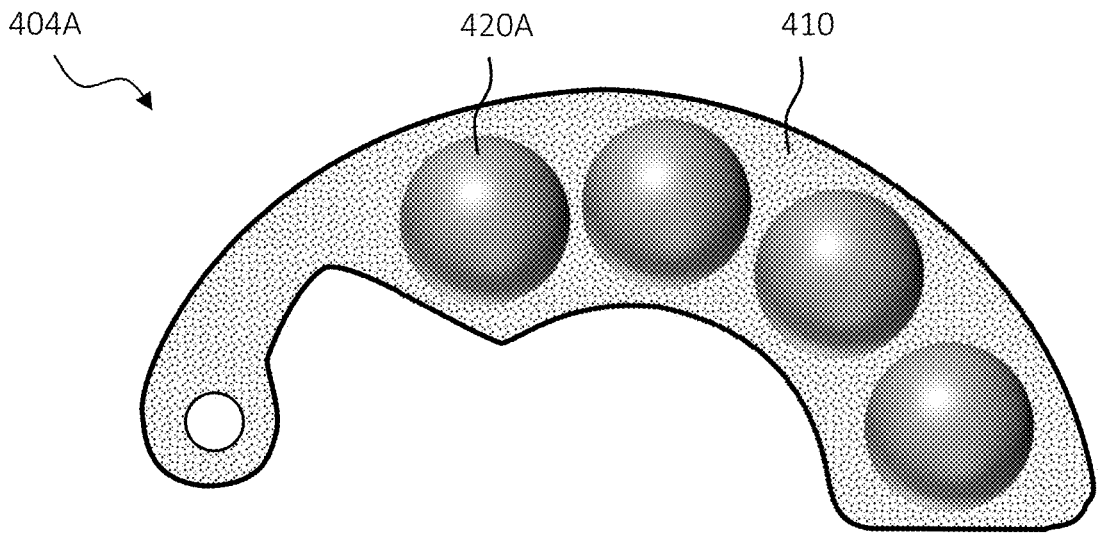
FIGS. 4A through 4K illustrate cross-sectional views of a variety of different floats (e.g., paddled shaped floats) designed, manufactured, and operated according to one or more embodiments of the disclosure, as might be used with the fluid flow control device of FIG. 3.

With initial reference to FIG. 4A, illustrated is one embodiment of a float 404A designed, manufactured, and operated according to one or more embodiments of the disclosure. The float 404A includes a base material 410 having one or more hollow ceramic shells 420A encapsulated or enclosed therein. The base material 410, in the illustrated embodiment of FIG. 4A, comprises many different materials while remaining within the scope of the present disclosure. In the illustrated embodiment, the base material 410 includes one or more hollow ceramic shells 420A, which in certain examples is four or more hollow ceramic shells. In the embodiment of FIG. 4A, the plurality of hollow ceramic shells 420A are a plurality of spherical hollow ceramic shells 420A. Furthermore, the plurality of hollow ceramic shells 420A of the embodiment of FIG. 4A are substantially similarly shaped and/or similarly sized, if not entirely similar shaped or similarly sized, hollow ceramic shells 420A. The plurality of hollow ceramic shells 420A, in the illustrated embodiment, may additionally be substantially equally spaced hollow ceramic shells, and are optionally substantially equally distributed hollow ceramic shells. The term "substantially", as used herein with regard to shape, size, spacing, and distribution, is intended to include + or − ten percent of exactly shaped, sized or spaced. In other embodiments, a multitude of sizes of hollow ceramic shells 420A are used in order to allow more open space.

In at least one embodiment, the plurality of hollow ceramic shells 420A are filled with air. In yet another embodiment, the plurality of hollow ceramic shells 420A are filled with another fluid (e.g., gas and/or liquid) other than air. For example, the plurality of hollow ceramic shells 420A could be filled with an inert gas, such as nitrogen, $CO_2$, argon, etc., among others. In other embodiments, the plurality of hollow ceramic shells 420A could be filled with an inert fluid, among other fluids.

Figure 4B:
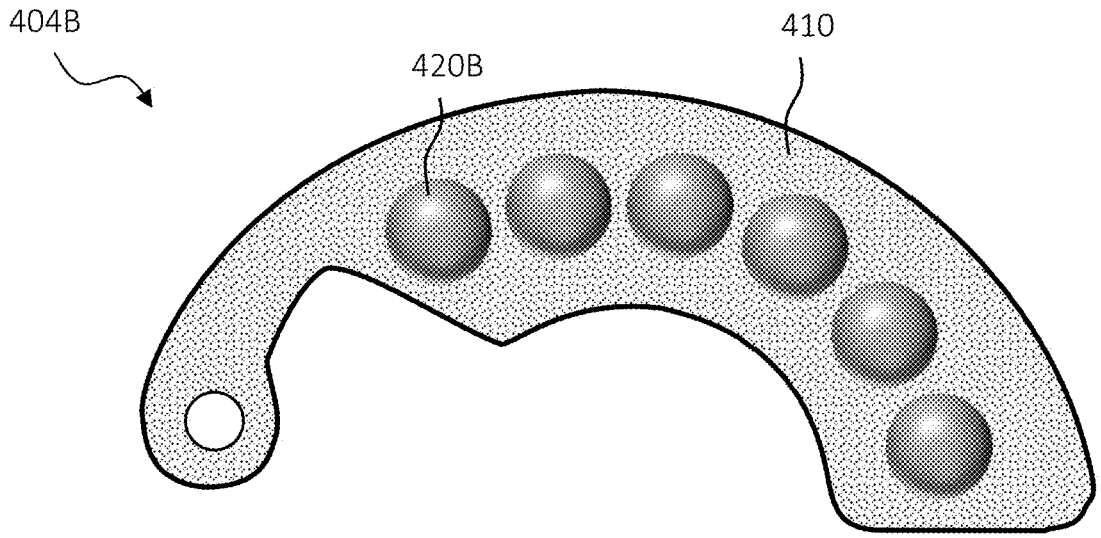

Turning now to FIG. 4B, illustrated is an alternative embodiment of a float 404B designed, manufactured, and operated according to another embodiment of the disclosure. The float 404B is similar in many respects to the float 404A of FIG. 4A. Accordingly, like reference numbers have been used to indicate similar, if not identical, features. The float 404B differs, for the most part, from the float 404A in that the float 404B employs multiple smaller hollow ceramic shells 420B. The multiple smaller hollow ceramic shells 420B, in the embodiment of FIG. 4B, are substantially equally spaced, and substantially equally distributed. For example, the float 404B has six or more substantially equally spaced hollow ceramic shells 420B.

Figure 4C:
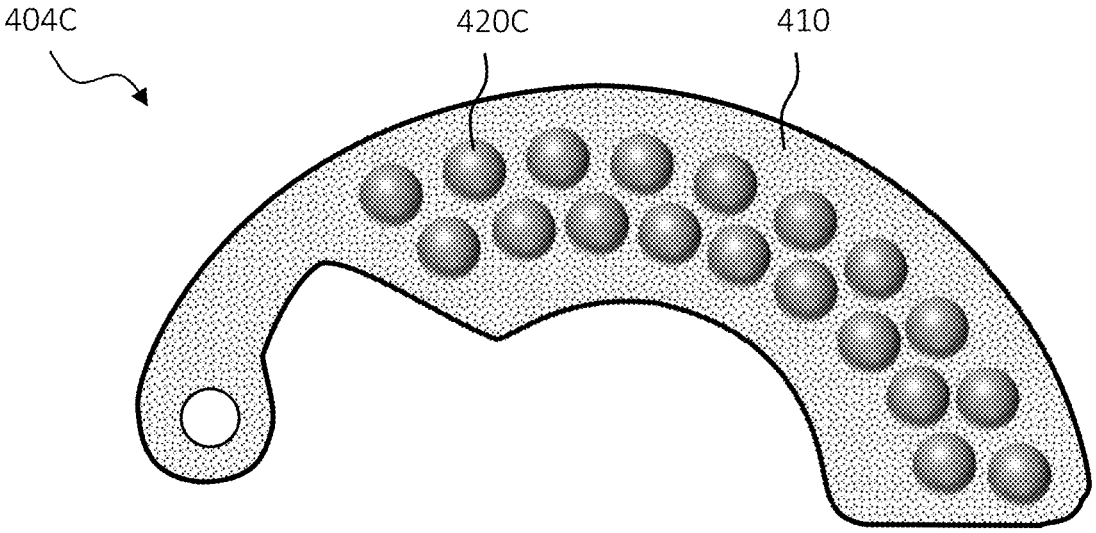

Turning now to FIG. 4C, illustrated is an alternative embodiment of a float 404C designed, manufactured, and operated according to another embodiment of the disclosure. The float 404C is similar in many respects to the float 404B of FIG. 4B. Accordingly, like reference numbers have been used to indicate similar, if not identical, features. The float 404C differs, for the most part, from the float 404B in that the float 404C employs multiple rows of smaller hollow ceramic shells 420C. In the embodiment of FIG. 4C, the multiple rows of smaller hollow ceramic shells 420C are equally spaced.

Figure 4D:
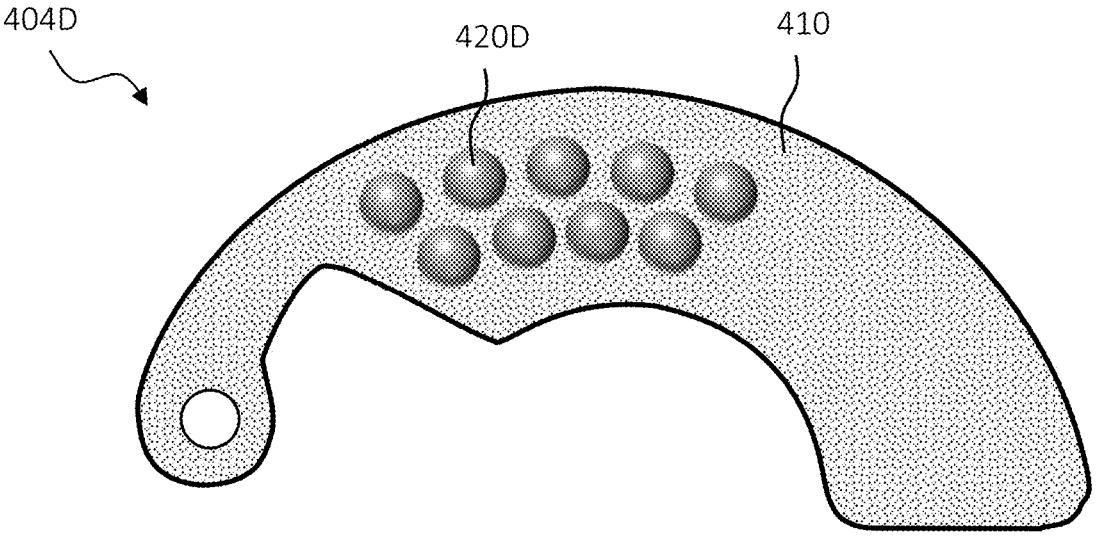

Turning now to FIG. 4D, illustrated is an alternative embodiment of a float 404D designed, manufactured, and operated according to another embodiment of the disclosure. The float 404D is similar in many respects to the float 404C of FIG. 4C. Accordingly, like reference numbers have been used to indicate similar, if not identical, features. The float 404D differs, for the most part, from the float 404C in that the multiple rows of smaller hollow ceramic shells 420D are equally spaced, but are concentrated together to alter the center of gravity of the float 404D. For example, wherein a center of gravity of the float 404C would be substantially at a midpoint of a width and height of the float 404C, the center of gravity of the float 404D would be to the right of the midpoint of the width of the float 404D.

Figure 4E:
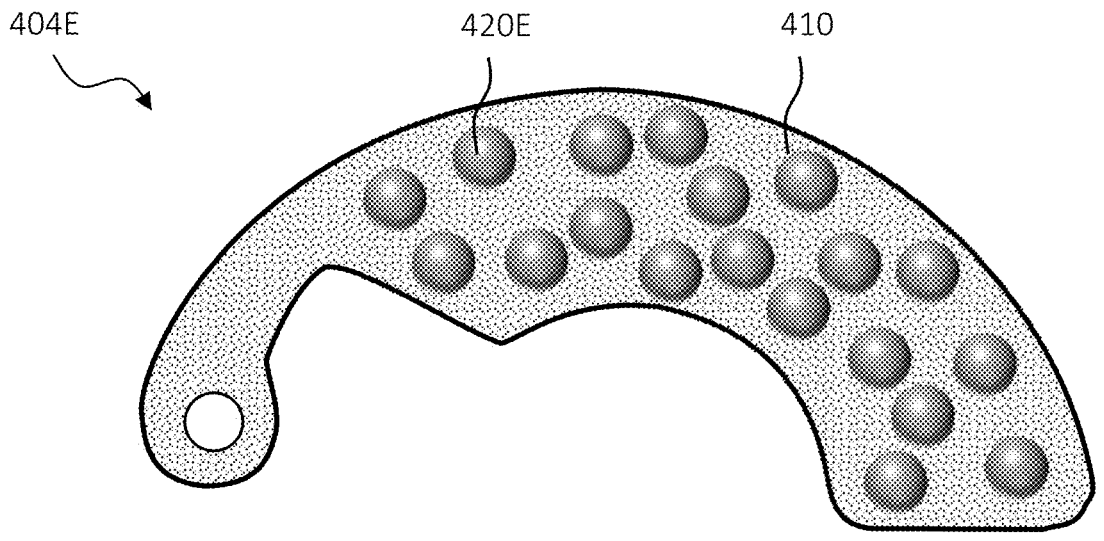

Turning now to FIG. 4E, illustrated is an alternative embodiment of a float 404E designed, manufactured, and operated according to another embodiment of the disclosure. The float 404E is similar in many respects to the float 404C of FIG. 4C. Accordingly, like reference numbers have been used to indicate similar, if not identical, features. The float 404E differs, for the most part, from the float 404C in that the smaller hollow ceramic shells 420E are not equally spaced. For example, in at least one embodiment, the smaller hollow ceramic shells 420E are randomly spaced.

Figure 4F:
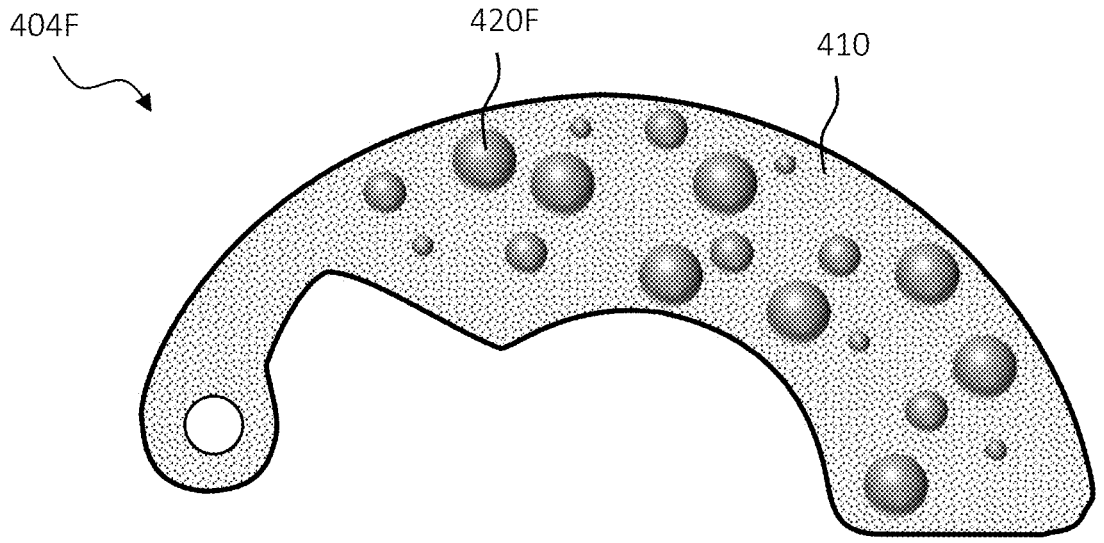

Turning now to FIG. 4F, illustrated is an alternative embodiment of a float 404F designed, manufactured, and operated according to another embodiment of the disclosure. The float 404F is similar in many respects to the float 404E of FIG. 4E. Accordingly, like reference numbers have been used to indicate similar, if not identical, features. The float 404F differs, for the most part, from the float 404E in that the smaller hollow ceramic shells 420F are randomly spaced and have two or more different sizes. In the illustrated embodiment of FIG. 4F, the smaller hollow ceramic shells 420F have three or more different sizes.

Figure 4G:
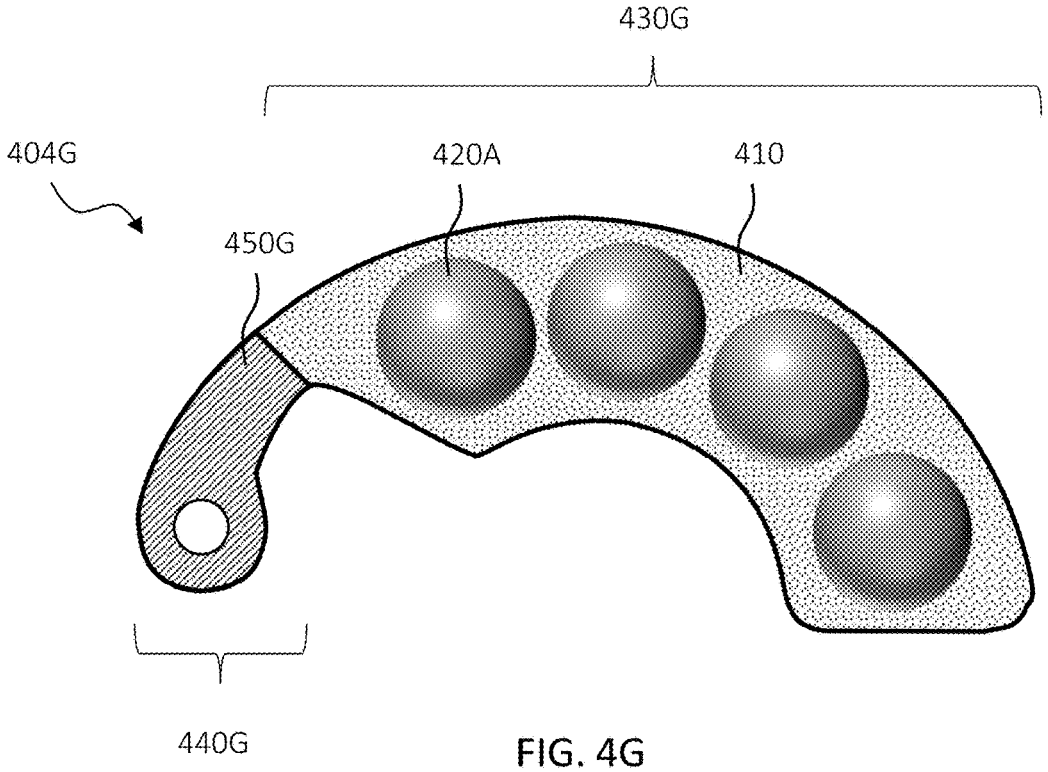

Turning now to FIG. 4G, illustrated is an alternative embodiment of a float 404G designed, manufactured, and operated according to another embodiment of the disclosure. The float 404G is similar in many respects to the float 404A of FIG. 4A. Accordingly, like reference numbers have been used to indicate similar, if not identical, features. The float 404G differs, for the most part, from the float 404A, in that the float 404G includes a critical density area 430G and a non-critical density area 440G. The critical density area 430G could include the base material 410 and one or more hollow ceramic shells 420A, whereas the non-critical density area 440G could comprise a different base material 450G. The size, shape and density of the critical density area 430G and the non-critical density area 440G may be tailored for one or more specific applications. Those skilled in the art understand the various different materials that the different base material 450G may comprise, including metal in one embodiment.

Figure 4H:
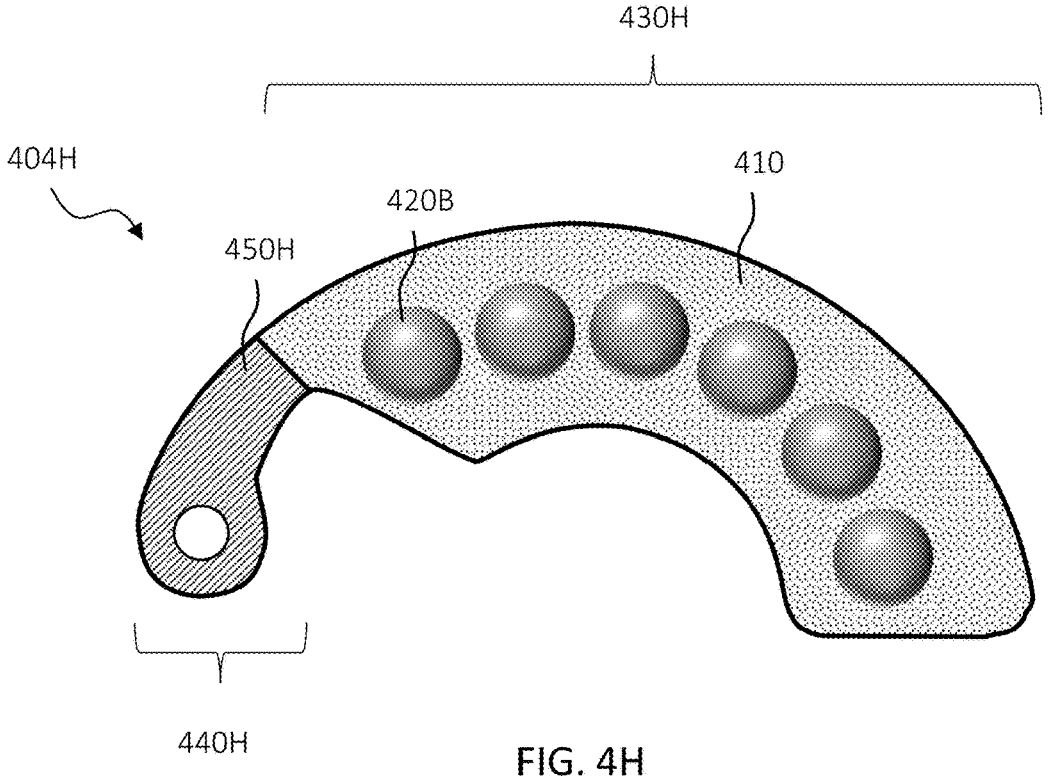

Turning now to FIG. 4H, illustrated is an alternative embodiment of a float 404H designed, manufactured, and operated according to another embodiment of the disclosure. The float 404H is similar in many respects to the float 404B of FIG. 4B. Accordingly, like reference numbers have been used to indicate similar, if not identical, features. The float 404H differs, for the most part, from the float 404B, in that the float 404H includes a critical density area 430H and a non-critical density area 440H. The critical density area 430H could include the base material 410, whereas the non-critical density area 440H could comprise a different base material 450H. The size, shape and density of the critical density area 430H and the non-critical density area 440H may be tailored for one or more specific applications. Those skilled in the art understand the various different materials that the different base material 450H may comprise, including metal in one embodiment.

Figure 4I:
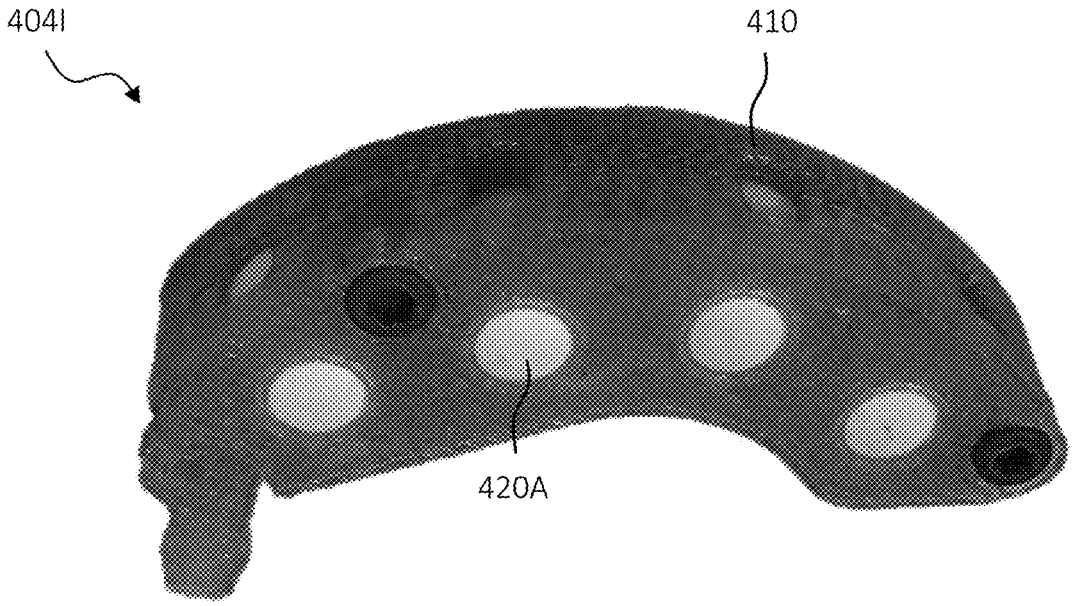

Turning now to FIG. 4I, illustrated is an alternative embodiment of a float 404J designed, manufactured, and operated according to another embodiment of the disclosure. The float 404J is similar in many respects to the float 404A of FIG. 4A. Accordingly, like reference numbers have been used to indicate similar, if not identical, features. The float 404J differs, for the most part, from the float 404A, in that the float 404I includes a caged design. For example, the caged design of FIG. 4I might include two or more sections that connect together to encapsulate or enclose the one or more hollow ceramic shells 420A. In at least one embodiment, the float 404I includes two sections that connect together, for example using a fastener (e.g., screw type fastener), a snap-type features, or an adhesive. encompass or a critical density area 430G and a non-critical density area 440G. In at least one other embodiment, the caged design exposes at least a portion of the one or more hollow ceramic shells 420.

Figure 4J:
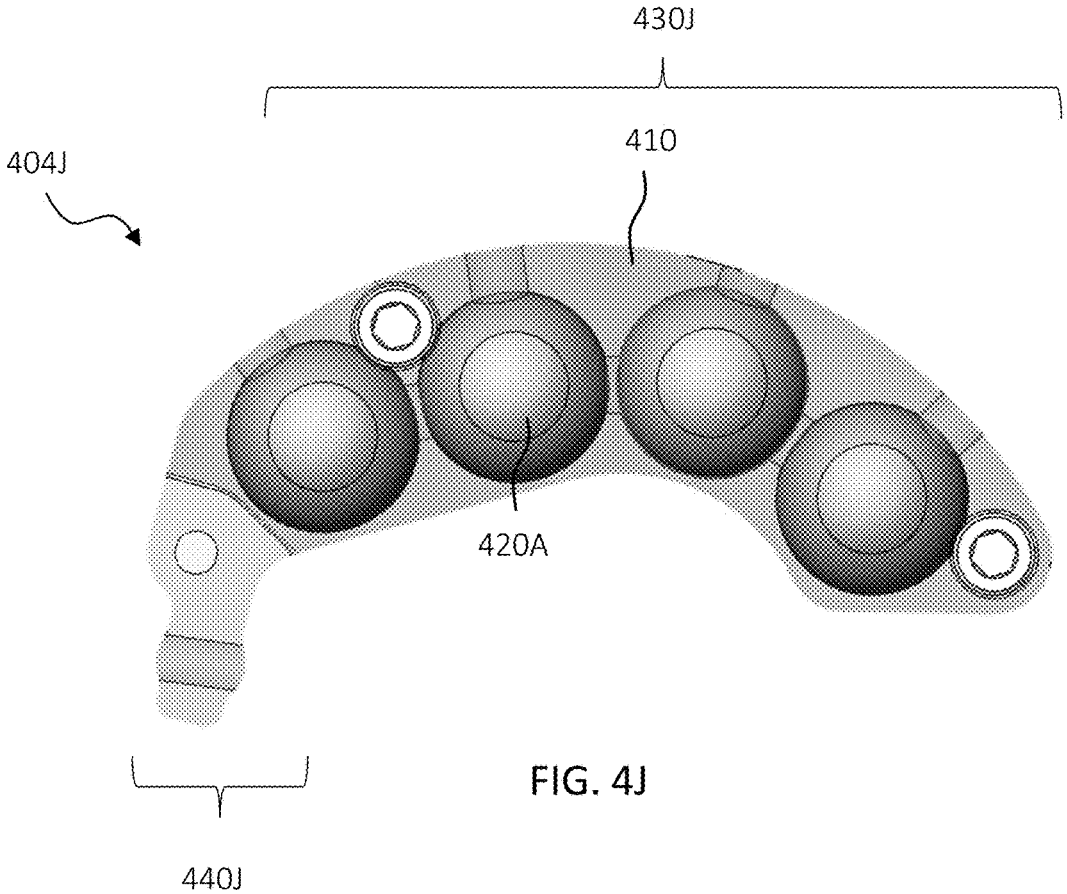

Turning now to FIG. 4J, illustrated is an alternative embodiment of a float 404J designed, manufactured, and operated according to another embodiment of the disclosure. The float 404J is similar in many respects to the float 404I of FIG. 4I. Accordingly, like reference numbers have been used to indicate similar, if not identical, features. The float 404J differs, for the most part, from the float 404I, in that the float 404J includes a critical density area 430J and a non-critical density area 440J, for example as discussed above.

Figure 4K:
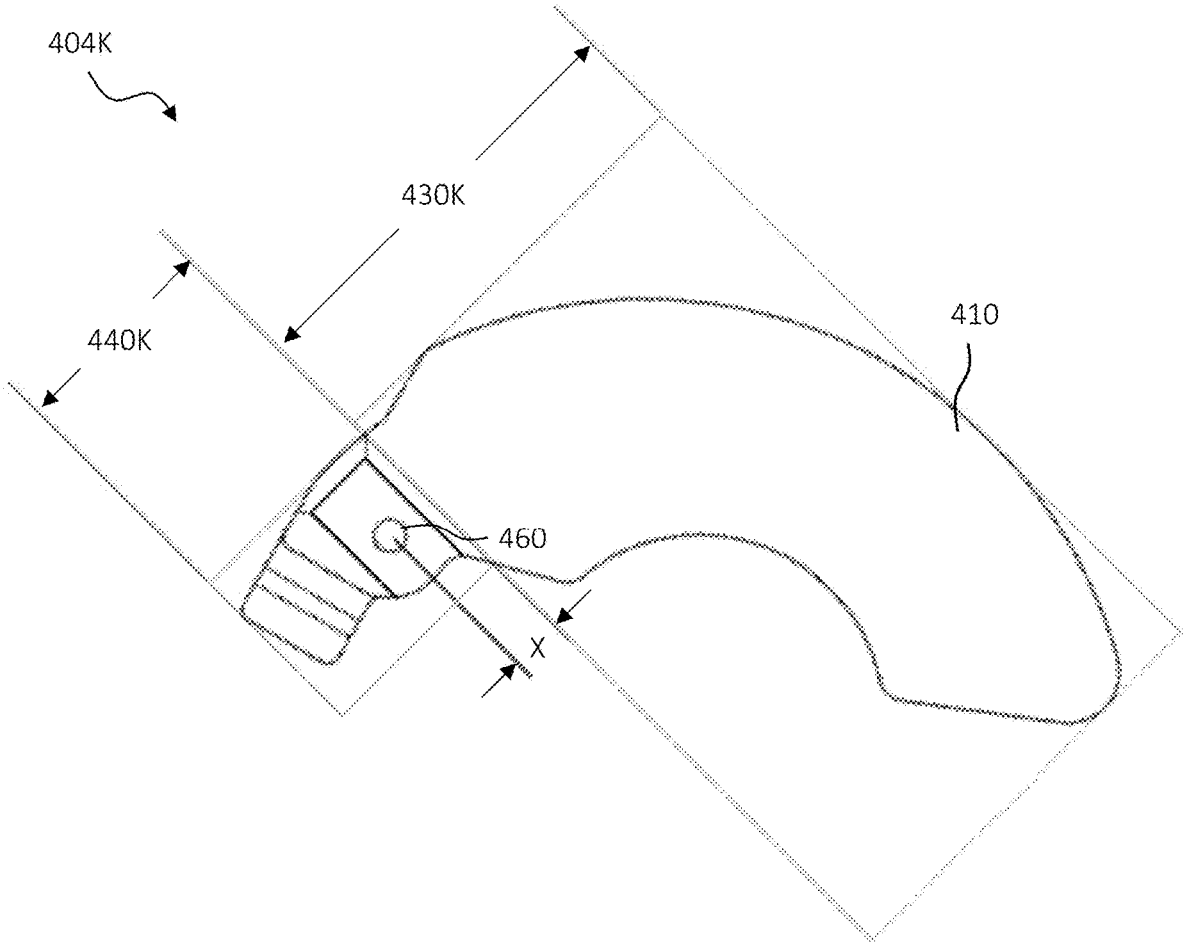

Turning now to FIG. 4K, illustrated is an alternative embodiment of a float 404K designed, manufactured, and operated according to another embodiment of the disclosure. The float 404K is similar in many respects to the float 404J of FIG. 4J. Accordingly, like reference numbers have been used to indicate similar, if not identical, features. The float 404K differs, for the most part, from the float 404J, in that the float 404K includes a critical density area 430K and a non-critical density area 440K, for example as discussed above. In at least one embodiment, the critical density area 430K has a density ranging from 0.80 g/cm$^3$ to 0.95 g/cm$^3$. In at least one other embodiment, the critical density area 430K has a density ranging from 0.83 g/cm$^3$ to 0.92 g/cm$^3$, and in yet one other embodiment a density ranging from 0.85 g/cm$^3$ to 0.90 g/cm$^3$. Further to the embodiment of FIG. 4K, the critical density area 430K could have a width of 1.065 inches, whereas the non-critical density area 440K could have a width of 0.52 inches. Further to the embodiment of FIG. 4K, an opening 460, in the non-critical density area 440K might be a distance (X) of 0.13 inches from the critical density area 440K.

Figure 5A:
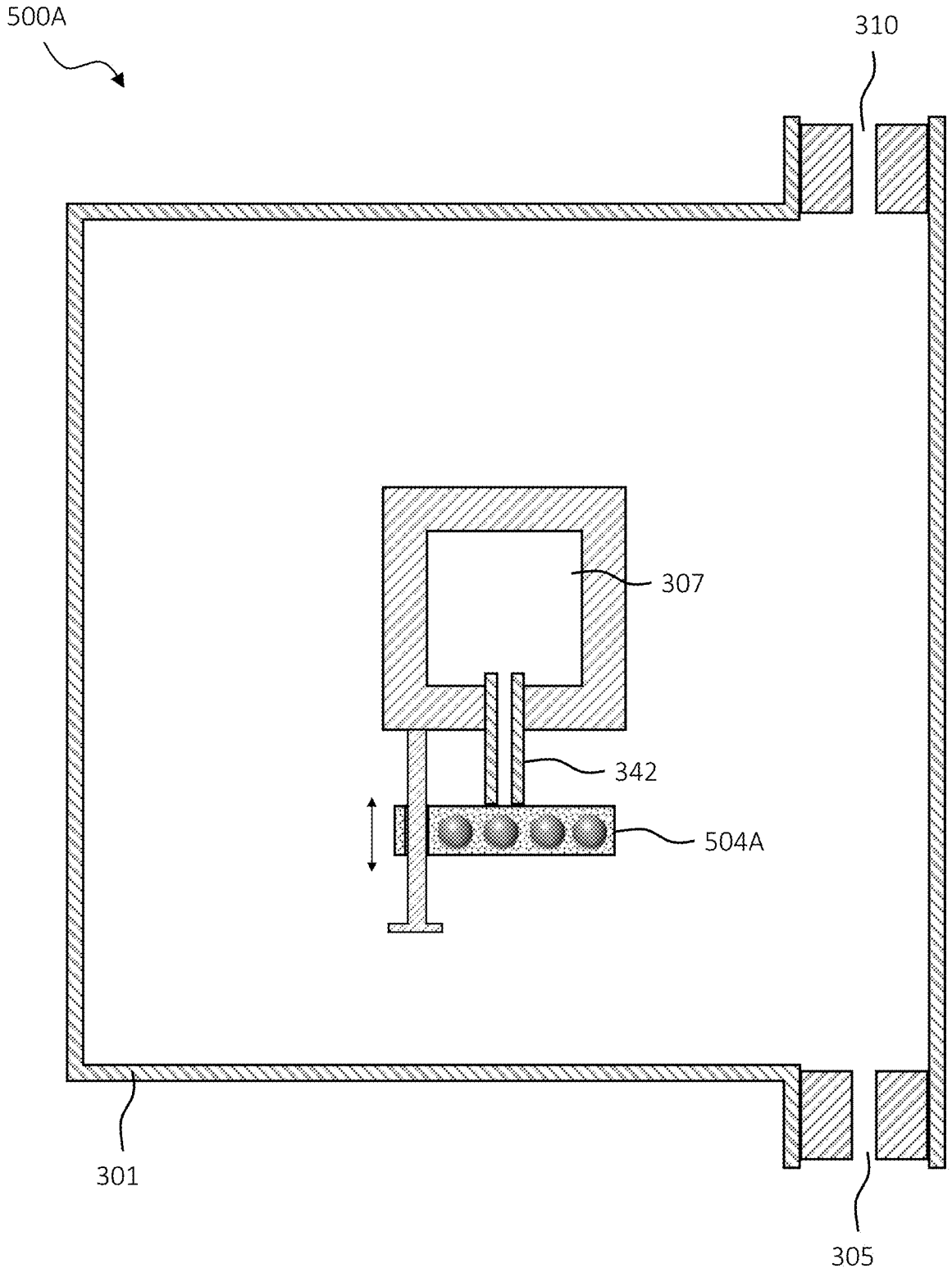
FIGS. 5A and 5B illustrate cross-sectional views of an alternative embodiments of a fluid flow control device designed, manufactured, and operated according to one or more embodiments of the disclosure.

Turning to FIG. 5A, illustrated is a cross-sectional view of an alternative embodiment of a fluid flow control device 500A designed, manufactured, and operated according to one or more embodiments of the disclosure. The fluid flow control device 500A is similar in many respects to the fluid flow control device 300 of FIG. 3. Accordingly, like reference numbers have been used to indicate similar, if not identical, features. The fluid flow control device 500A differs, for the most part, from the fluid flow control device 300, in that the fluid flow control device 500A does not employ the rotatable component 308. Alternatively, the fluid flow control device 500A employs a single paddle shaped float 504A. The single paddle shaped float 504A, in at least the illustrated embodiment, is operable to slide (e.g., linearly slide in one embodiment) between the open and closed positions, for example based upon the density of the fluid within the housing 301. In the embodiment of FIG. 5A, the single paddle shaped float 504A is configured to float upward to the closed position and sink downward to the open position, for example based upon the density of the fluid within the housing 301.

Figure 5B:
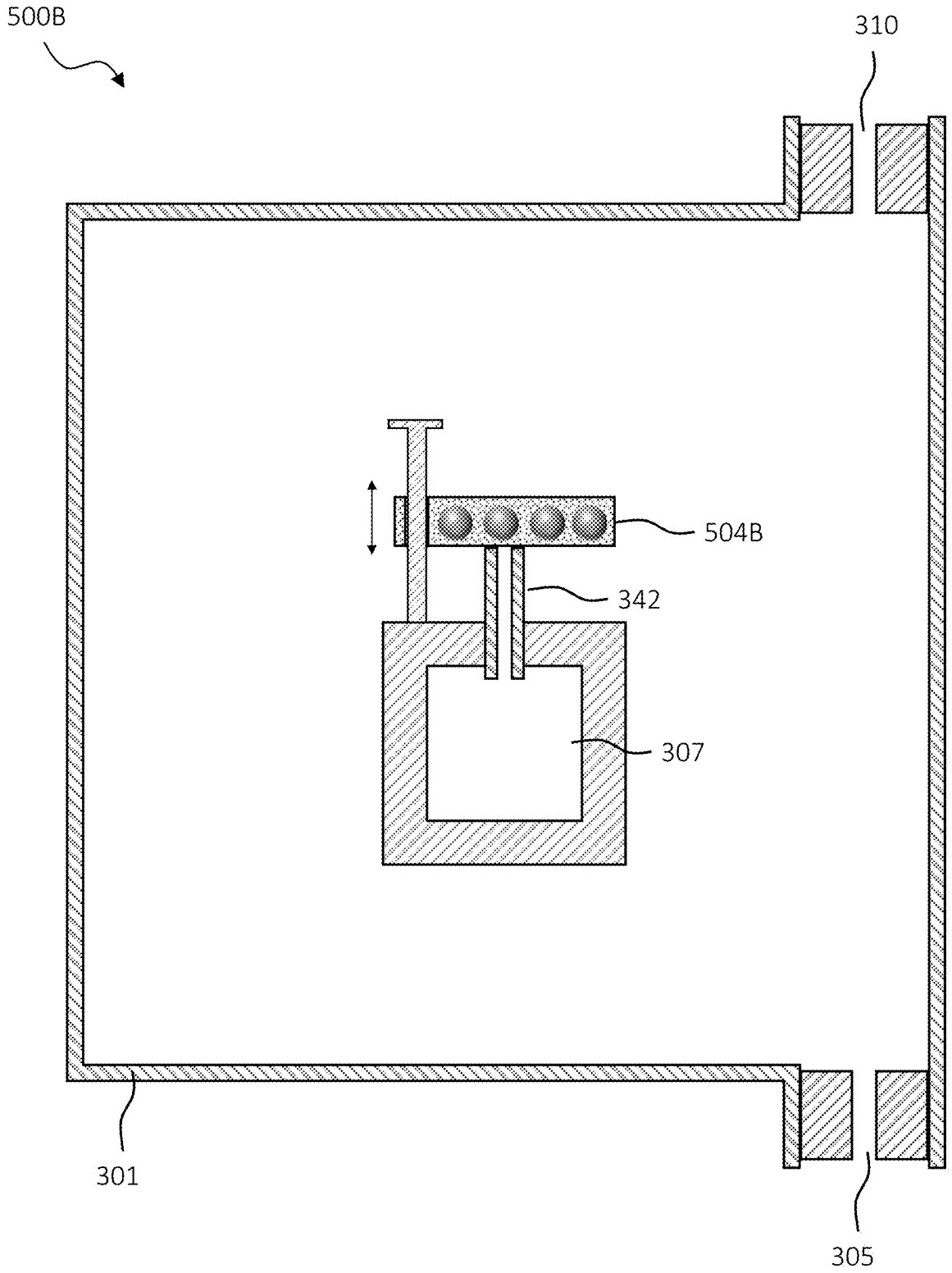

Turning to FIG. 5B, illustrated is a cross-sectional view of an alternative embodiment of a fluid flow control device 500B designed, manufactured, and operated according to one or more embodiments of the disclosure. The fluid flow control device 500B is similar in many respects to the fluid flow control device 500A of FIG. 5A. Accordingly, like reference numbers have been used to indicate similar, if not identical, features. The fluid flow control device 500B differs, for the most part, from fluid flow control device 500A, in that the single paddle shaped float 504B is configured to float upward to the open position and sink downward to the closed position, for example based upon the density of the fluid within the housing 301.

FIGS. 6A through 6H illustrate cross-sectional views of a variety of different floats (e.g., paddled shaped floats) 604A-604H designed, manufactured, and operated according to one or more embodiments of the disclosure, as might be used with the fluid flow control device 500A, 500B of FIGS. 5A and 5B. For example, each of the floats 604A-604H could be configured to slide (e.g., linearly slide) back and forth between the open and closed positions.

Each of the different floats 604A-604H, or at least a portion of each of the different floats 604A-604H, includes a one or more hollow ceramic shells encapsulated within or enclosed within a base material (e.g., a polymer product such as Polyether ether ketone (PEEK)). Specifically, the one or more hollow ceramic shells, and in certain embodiments in addition to the base material, have been employed to provide a float 604A-604H having a highly specific net density (e.g., combined density of all the associated parts of the float). In at least one embodiment, the float has a net density that is above a first density of a desired fluid and below a second density of an undesired fluid. In another embodiment, the float has a net density that is above a first density of an undesired fluid and below a second density of a desired fluid. In at least one other embodiment, the native density of the base material and/or the fluid impermeable exterior is greater than the first density or the second density. For example, the native density of the base material and/or the fluid impermeable exterior may be 1.3 sg or greater.

Figure 6A:
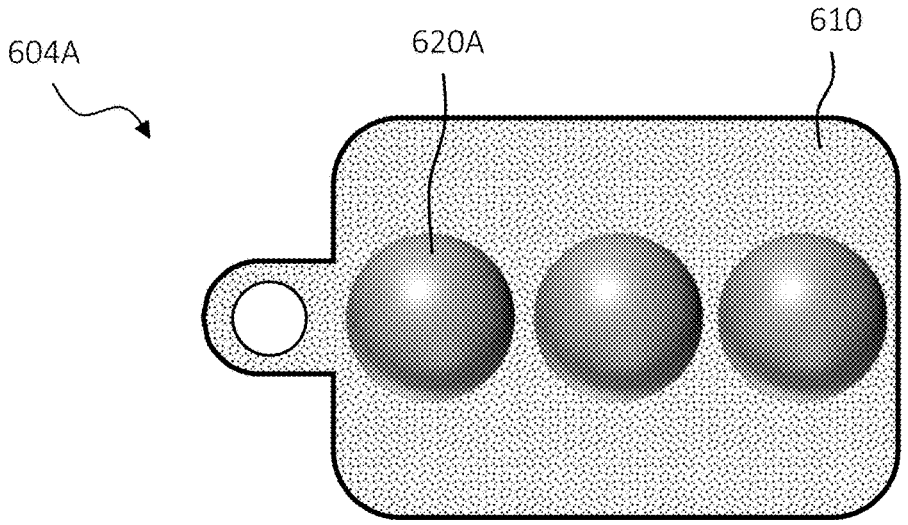
FIGS. 6A through 6H illustrate cross-sectional views of a variety of different floats (e.g., paddled shaped floats) designed, manufactured, and operated according to one or more embodiments of the disclosure, as might be used with the fluid flow control device of FIG. 5A or 5B.

With initial reference to FIG. 6A, illustrated is one embodiment of a float 604A designed, manufactured, and operated according to one or more embodiments of the disclosure. The float 604A includes a base material 610 having one or more hollow ceramic shells 620A encapsulated or enclosed therein. The base material 610, in the illustrated embodiment of FIG. 6A, comprises many different materials while remaining within the scope of the present disclosure. In the illustrated embodiment, the base material 610 includes one or more hollow ceramic shells 620A, which in certain examples is four or more hollow ceramic shells. In the embodiment of FIG. 6A, the plurality of hollow ceramic shells 620A are a plurality of spherical hollow ceramic shells 620A. Furthermore, the plurality of hollow ceramic shells 620A of the embodiment of FIG. 6A are substantially similarly shaped and/or similarly sized, if not entirely similar shaped or similarly sized, hollow ceramic shells 620A. The plurality of hollow ceramic shells 620A, in the illustrated embodiment, may additionally be substantially equally spaced hollow ceramic shells, and are optionally substantially equally distributed hollow ceramic shells. The term "substantially", as used herein with regard to shape, size, spacing, and distribution, is intended to include + or – ten percent of exactly shaped, sized or spaced. In other embodiments, a multitude of sizes of hollow ceramic shells 620A are used in order to allow more open space.

In at least one embodiment, the plurality of hollow ceramic shells 620A are filled with air. In yet another embodiment, the plurality of hollow ceramic shells 620A are filled with another fluid (e.g., gas and/or liquid) other than air. For example, the plurality of hollow ceramic shells 620A could be filled with an inert gas, such as nitrogen, $CO_2$, argon, etc., among others. In other embodiments, the plurality of hollow ceramic shells 620A could be filled with an inert fluid, among other fluids.

Figure 6B:
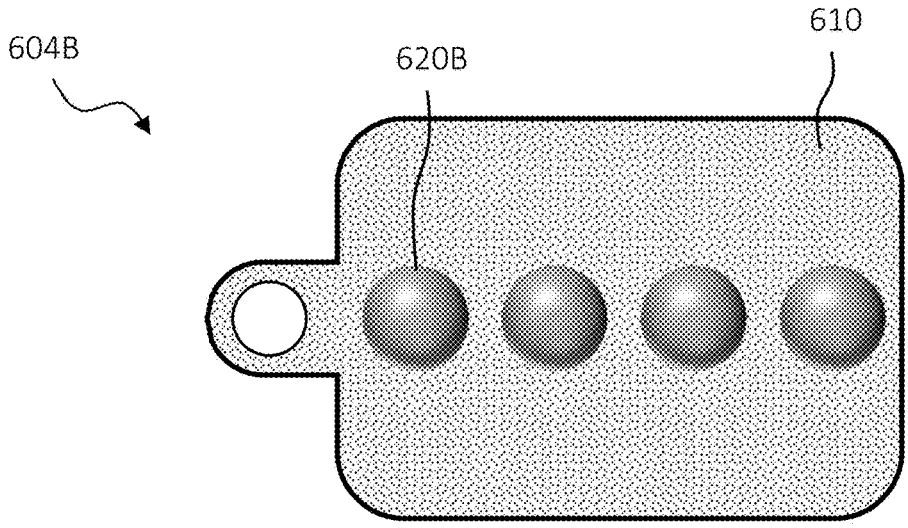

Turning now to FIG. 6B, illustrated is an alternative embodiment of a float 604B designed, manufactured, and operated according to another embodiment of the disclosure. The float 604B is similar in many respects to the float 604A of FIG. 6A. Accordingly, like reference numbers have been used to indicate similar, if not identical, features. The float 604B differs, for the most part, from the float 604A in that the float 604B employs multiple smaller hollow ceramic shells 620B. The multiple smaller hollow ceramic shells 620B, in the embodiment of FIG. 6B, are substantially equally spaced, and substantially equally distributed. For example, the float 604B has four or more substantially equally spaced hollow ceramic shells 620B.

Figure 6C:
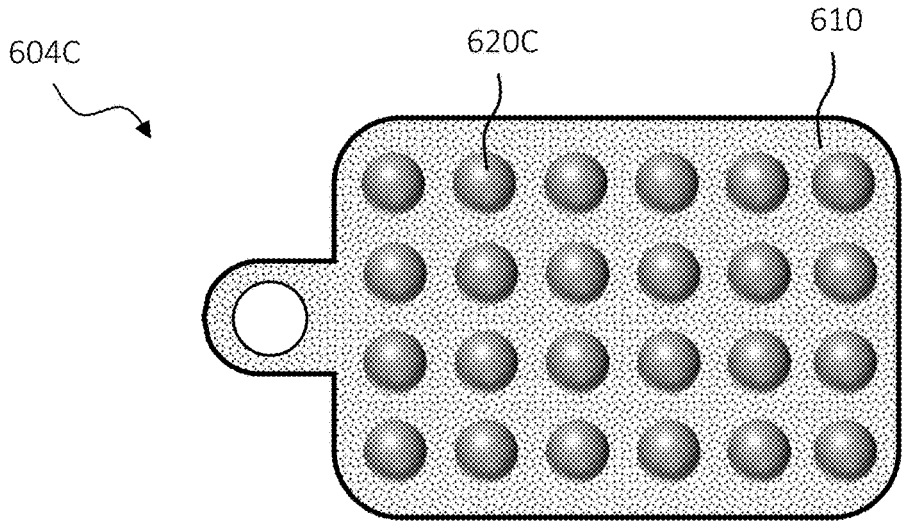

Turning now to FIG. 6C, illustrated is an alternative embodiment of a float 604C designed, manufactured, and operated according to another embodiment of the disclosure. The float 604C is similar in many respects to the float 604B of FIG. 6B. Accordingly, like reference numbers have been used to indicate similar, if not identical, features. The float 604C differs, for the most part, from the float 604B in that the float 604C employs multiple rows of smaller hollow ceramic shells 620C. In the embodiment of FIG. 6C, the multiple rows of smaller hollow ceramic shells 620C are equally spaced. In at least one embodiment, the float 604C has two or more rows of smaller hollow ceramic shells, three or more rows of smaller hollow ceramic shells, or four or more rows of smaller hollow ceramic shells.

Figure 6D:
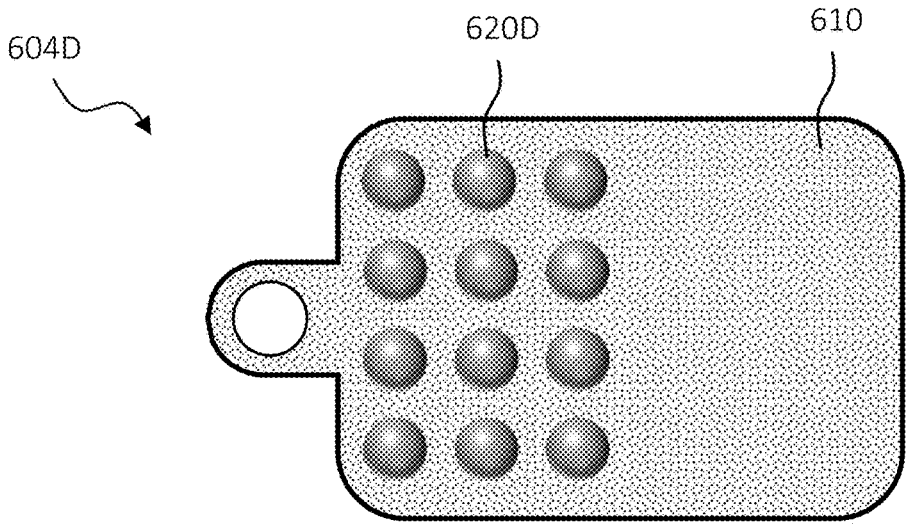

Turning now to FIG. 6D, illustrated is an alternative embodiment of a float 604D designed, manufactured, and operated according to another embodiment of the disclosure. The float 604D is similar in many respects to the float 604C of FIG. 6C. Accordingly, like reference numbers have been used to indicate similar, if not identical, features. The float 604D differs, for the most part, from the float 604C in that the multiple rows of smaller hollow ceramic shells 620D are equally spaced, but are concentrated together to alter the center of gravity of the float 604D. For example, wherein a center of gravity of the float 604C would be substantially at a midpoint of a width and height of the float 604C, the center of gravity of the float 604D would be to the right of the midpoint of the width of the float 604D.

Figure 6E:
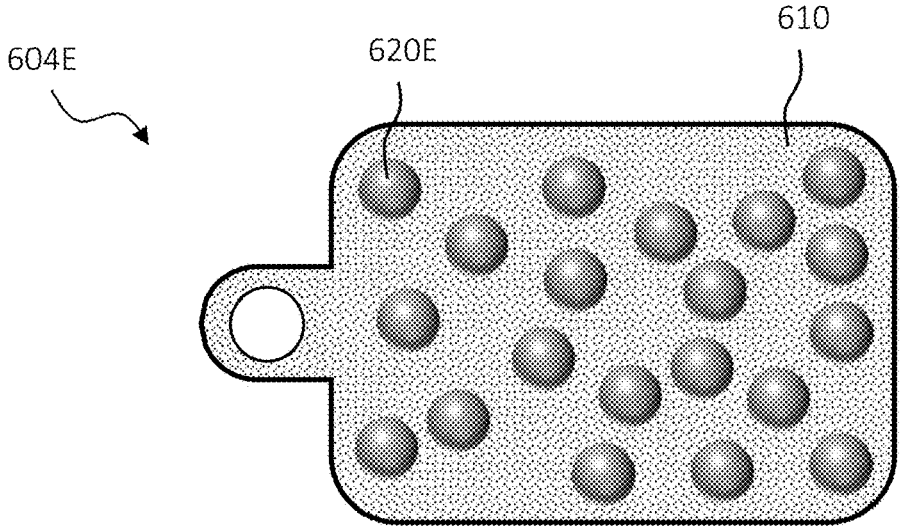

Turning now to FIG. 6E, illustrated is an alternative embodiment of a float 604E designed, manufactured, and operated according to another embodiment of the disclosure. The float 604E is similar in many respects to the float 604C of FIG. 6C. Accordingly, like reference numbers have been used to indicate similar, if not identical, features. The float 604E differs, for the most part, from the float 604C in that the smaller hollow ceramic shells 620E are not equally spaced. For example, in at least one embodiment, the smaller hollow ceramic shells 620E are randomly spaced.

Figure 6F:
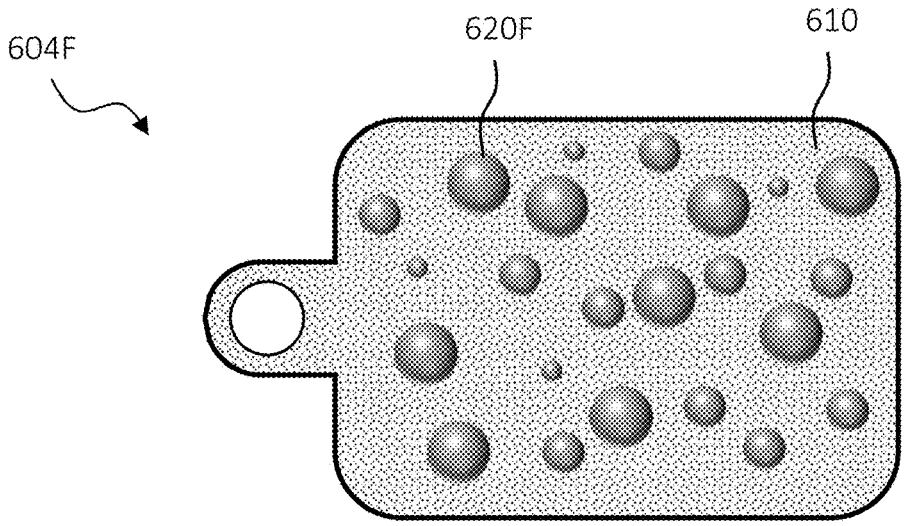

Turning now to FIG. 6F, illustrated is an alternative embodiment of a float 604F designed, manufactured, and operated according to another embodiment of the disclosure. The float 604F is similar in many respects to the float 604E of FIG. 6E. Accordingly, like reference numbers have been used to indicate similar, if not identical, features. The float 604F differs, for the most part, from the float 604E in that the smaller hollow ceramic shells 620F are randomly spaced and have two or more different sizes. In the illustrated embodiment of FIG. 6F, the smaller hollow ceramic shells 620F have three or more different sizes.

Figure 6G:
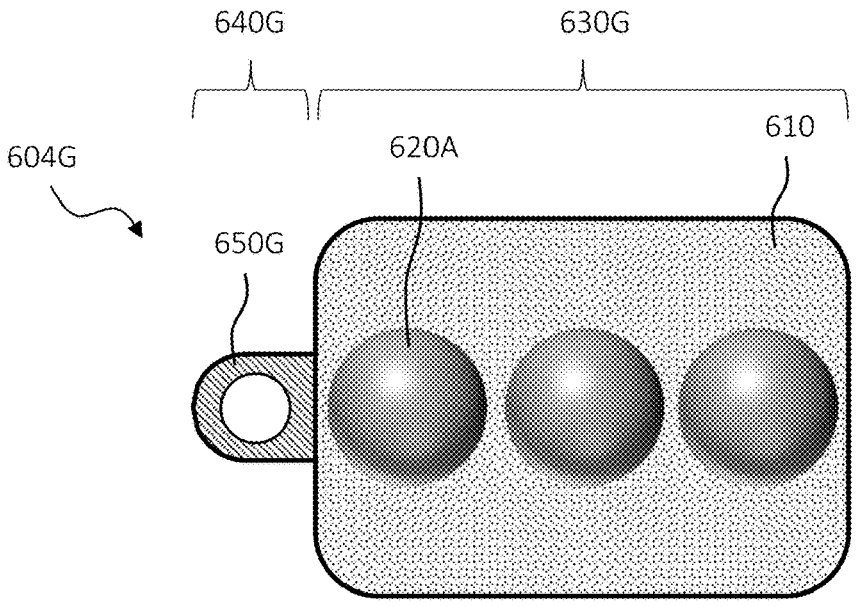

Turning now to FIG. 6G, illustrated is an alternative embodiment of a float 604G designed, manufactured, and operated according to another embodiment of the disclosure. The float 604G is similar in many respects to the float 604A of FIG. 6A. Accordingly, like reference numbers have been used to indicate similar, if not identical, features. The float 604G differs, for the most part, from the float 604A, in that the float 604G includes a critical density area 630G and a non-critical density area 640G. The critical density area 630G could include the base material 610 and one or more hollow ceramic shells 620A, whereas the non-critical density area 640G could comprise a different base material 650G. The size, shape and density of the critical density area 630G and the non-critical density area 640G may be tailored for one or more specific applications. Those skilled in the art understand the various different materials that the different base material 650G may comprise, including metal in one embodiment.

Figure 6H:
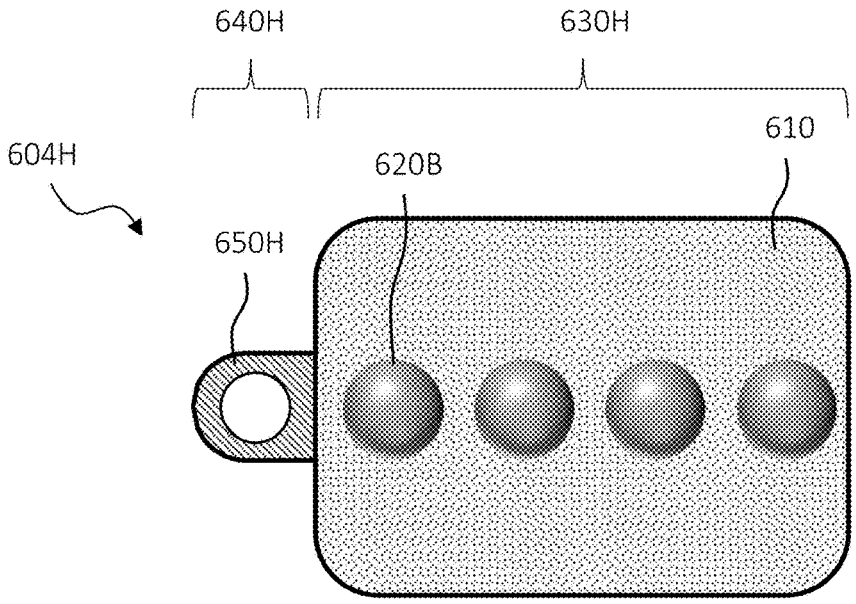

Turning now to FIG. 6H, illustrated is an alternative embodiment of a float 604H designed, manufactured, and operated according to another embodiment of the disclosure. The float 604H is similar in many respects to the float 604B of FIG. 6B. Accordingly, like reference numbers have been used to indicate similar, if not identical, features. The float 604H differs, for the most part, from the float 604B, in that the float 604H includes a critical density area 630H and a non-critical density area 640H. The critical density area 630H could include the base material 610 and one or more hollow ceramic shells 620B, whereas the non-critical density area 640H could comprise a different base material 650H. The size, shape and density of the critical density area 630H and the non-critical density area 640H may be tailored for one or more specific applications. Those skilled in the art understand the various different materials that the different base material 650H may comprise, including metal in one embodiment.

Turning to FIG. 7A, illustrated is a cross-sectional view of an alternative embodiment of a fluid flow control device 700A designed, manufactured, and operated according to one or more embodiments of the disclosure. The fluid flow control device 700A is similar in many respects to the fluid flow control device 300 of FIG. 3. Accordingly, like reference numbers have been used to indicate similar, if not identical, features. The fluid flow control device 700A differs, for the most part, from the fluid flow control device 300, in that the fluid flow control device 700A does not employ the rotatable component 308. Alternatively, the fluid flow control device 700A employs a single spherical shaped float 704. The single spherical shaped float 704, in at least the illustrated embodiment, is operable to float upward to close the fluid outlet 307 when its density is less than the fluid density of a desirable fluid, or sink downward to open the fluid outlet 307 when its density is greater than the fluid density of the desirable fluid. It should be apparent that the fluid flow control device 700 could be reversed so that the sphere 704 restricts the fluid outlet 307 when its density is greater than the fluid density of a desired fluid, such as shown in FIG. 7B.

Figure 8:
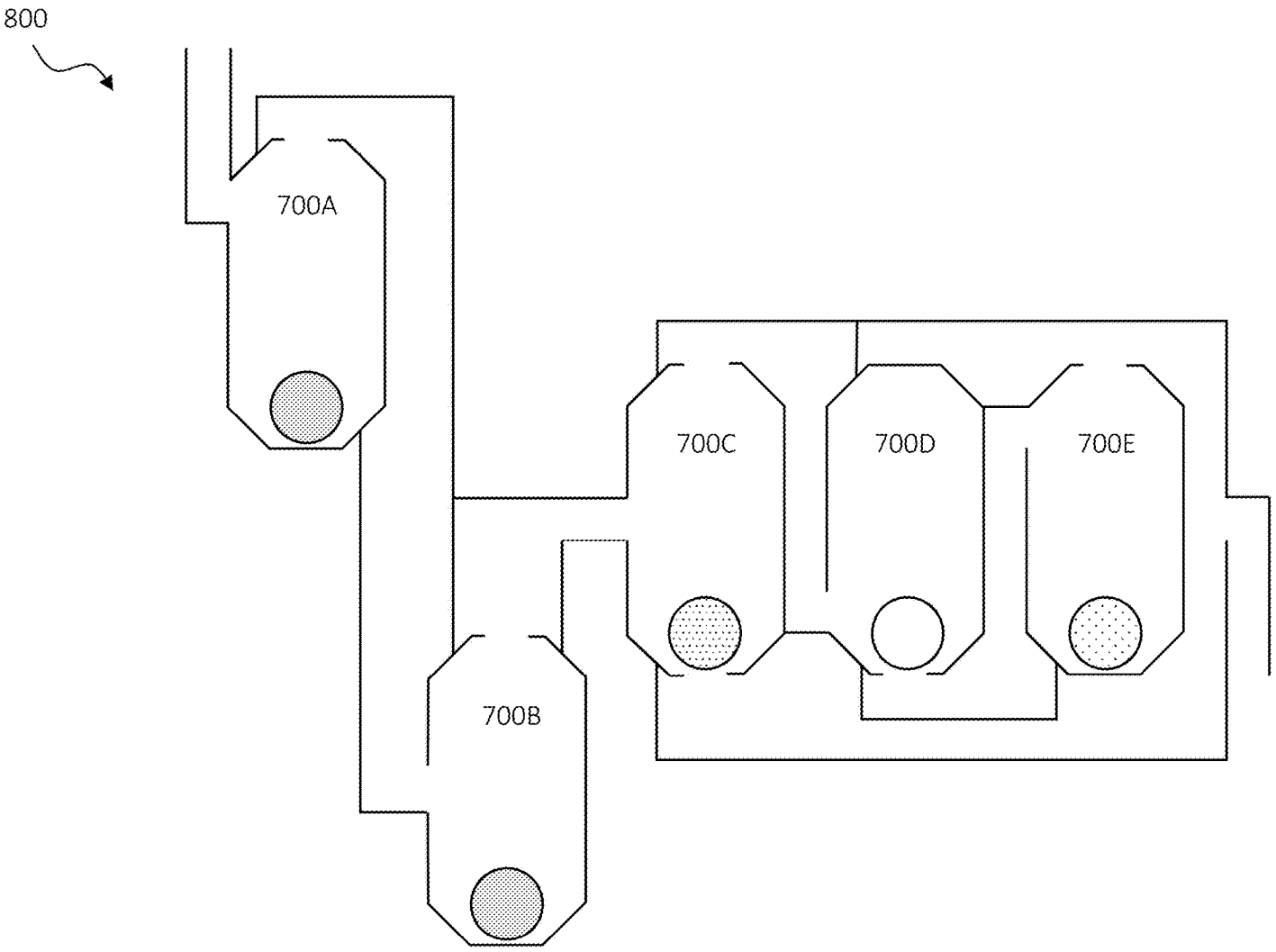
FIG. 8 illustrates an orientation dependent inflow control apparatus designed, manufactured, and operated according to one or more embodiments of the disclosure.

FIG. 8 illustrates an orientation dependent inflow control apparatus 800 designed, manufactured and operated according to one or more embodiments of the disclosure. In the embodiment of FIG. 8, multiple fluid flow control devices 700A-700E are stacked to assist with certain orientation issues that may exist when the fluid flow control device 700 is positioned on a tubular downhole. The multiple fluid flow control devices 700A-700E may also be used to discriminate fluid flow based upon more than just two different densities.

FIG. 9 illustrates a rolled-out view (360°) of a device 900 comprising four orientation dependent inflow control apparatuses 800A-800D equidistantly distributed around the perimeter outside of a basepipe (not shown). In FIG. 9 the reference indications x and x' are connected to one another, as well as the reference indications y and y' are connected to one another. Each of the four orientation dependent inflow control apparatuses 800A-800D is in fluid communication with a corresponding density control valve to form a density control valve system. The orientation of each of the four orientation dependent inflow control apparatuses 800A-800D is indicated by the g-vectors ($\vec{g}$) where the indication + is to be understood to be in a direction into the drawing, the downward arrow is in a direction vertically down, the is in a direction out of the drawing and the upward arrow is in a direction vertically up.

FIGS. 10A through 10F illustrate cross-sectional views of a variety of different floats (e.g., spherical shaped floats) 1004A-1004F designed, manufactured, and operated according to one or more embodiments of the disclosure, as might be used with the fluid flow control device 700A of FIG. 7A or fluid flow control device 700B of FIG. 7B. For example, each of the floats 1004A-1004F could be configured to float and/or sink back and forth between the open and closed positions.

Each of the different floats 1004A-1004F, or at least a portion of each of the different floats 1004A-1004F, includes a one or more hollow ceramic shells encapsulated within or enclosed within a base material (e.g., a polymer product such as Polyether ether ketone (PEEK)). Specifically, the one or more hollow ceramic shells, and in certain embodiments in addition to the base material, have been employed to provide a float 1004A-1004F having a highly specific net density (e.g., combined density of all the associated parts of the float). In at least one embodiment, the float has a net density that is above a first density of a desired fluid and below a second density of an undesired fluid. In another embodiment, the float has a net density that is above a first density of an undesired fluid and below a second density of a desired fluid. In at least one other embodiment, the native density of the base material and/or the fluid impermeable exterior is greater than the first density or the second density. For example, the native density of the base material and/or the fluid impermeable exterior may be 1.3 sg or greater.

Figure 10A:
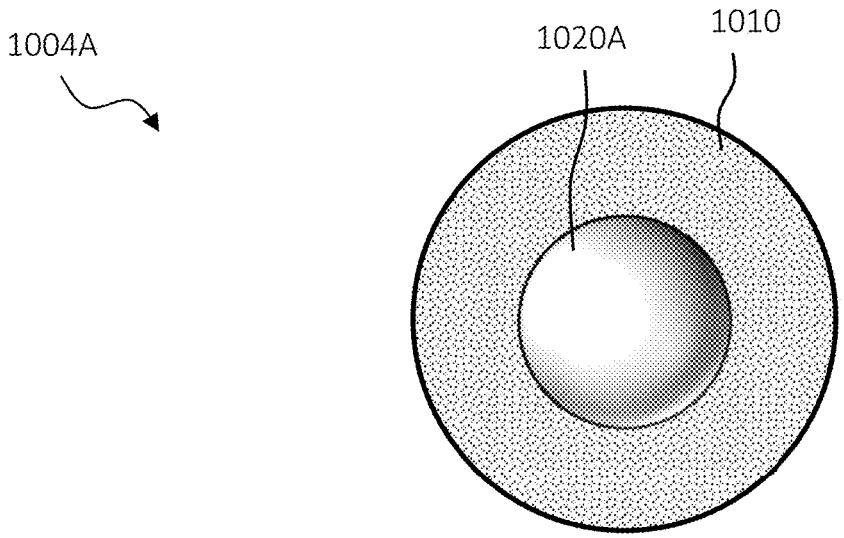

With initial reference to FIG. 10A, illustrated is one embodiment of a float 1004A designed, manufactured, and operated according to one or more embodiments of the disclosure. The float 1004A includes a base material 1010 having one or more hollow ceramic shells 1020A encapsulated or enclosed therein. The base material 1010, in the illustrated embodiment of FIG. 10A, comprises many different materials while remaining within the scope of the present disclosure. In the illustrated embodiment, the base material 1010 includes one or more hollow ceramic shells 1020A, which in certain examples is a single hollow ceramic shell.

In at least one embodiment, the one or more hollow ceramic shells 1020A are filled with air. In yet another embodiment, the one or more hollow ceramic shells 1020A are filled with another fluid (e.g., gas and/or liquid) other than air. For example, the one or more hollow ceramic shells 1020A could be filled with an inert gas, such as nitrogen, $CO_2$, argon, etc., among others. In other embodiments, the one or more hollow ceramic shells 1020A could be filled with an inert fluid, among other fluids.

Figure 10B:
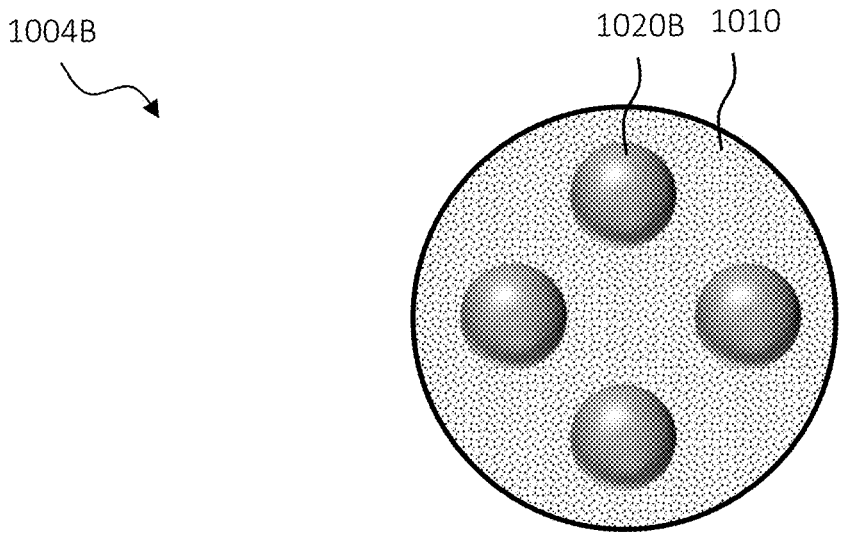

Turning now to FIG. 10B, illustrated is an alternative embodiment of a float 1004B designed, manufactured, and operated according to another embodiment of the disclosure. The float 1004B is similar in many respects to the float 1004A of FIG. 10A. Accordingly, like reference numbers have been used to indicate similar, if not identical, features. The float 1004B differs, for the most part, from the float 1004A in that the float 1004B employs multiple smaller hollow ceramic shells 1020B. For example, the float 1004B has four or more substantially equally spaced hollow ceramic shells 1020B. Furthermore, the multiple smaller hollow ceramic shells 1020B of the embodiment of FIG. 10B may be substantially similarly shaped and/or similarly sized, if not entirely similar shaped or similarly sized, hollow ceramic shells 1020B. The multiple smaller hollow ceramic shells 1020B, in the illustrated embodiment, may additionally be substantially equally spaced hollow ceramic shells, and are optionally substantially equally distributed hollow ceramic shells. The term "substantially", as used herein with regard to shape, size, spacing, and distribution, is intended to include + or − ten percent of exactly shaped, sized or spaced. In other embodiments, a multitude of sizes of hollow ceramic shells 1020B are used in order to allow more open space.

Figure 10C:
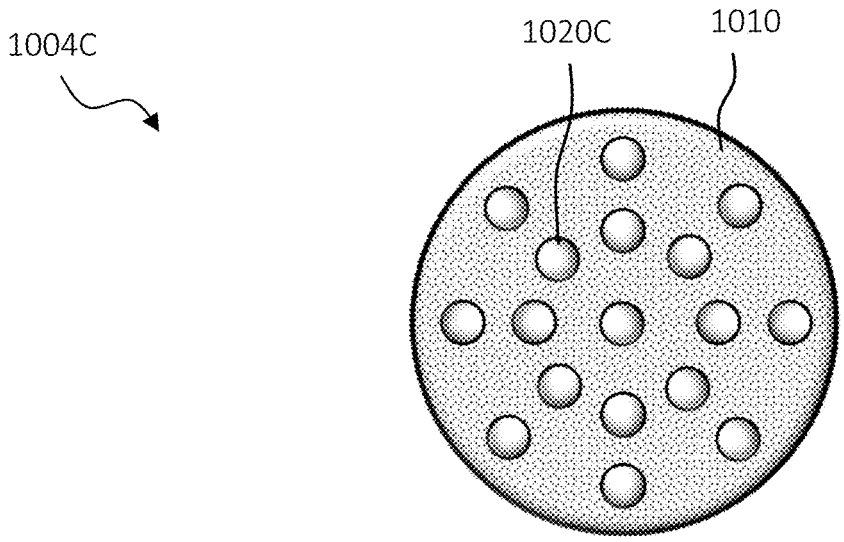

Turning now to FIG. 10C, illustrated is an alternative embodiment of a float 1004C designed, manufactured, and operated according to another embodiment of the disclosure. The float 1004C is similar in many respects to the float 1004B of FIG. 10B. Accordingly, like reference numbers have been used to indicate similar, if not identical, features. The float 1004C differs, for the most part, from the float 1004B in that the float 1004C employs multiple rings of smaller hollow ceramic shells 1020C. In the embodiment of FIG. 10C, the multiple rings of smaller hollow ceramic shells 1020C are equally spaced. In at least one embodiment, the float 1004C has two or more rings of smaller hollow ceramic shells, three or more rings of smaller hollow ceramic shells, or four or more rings of smaller hollow ceramic shells.

Figure 10D:
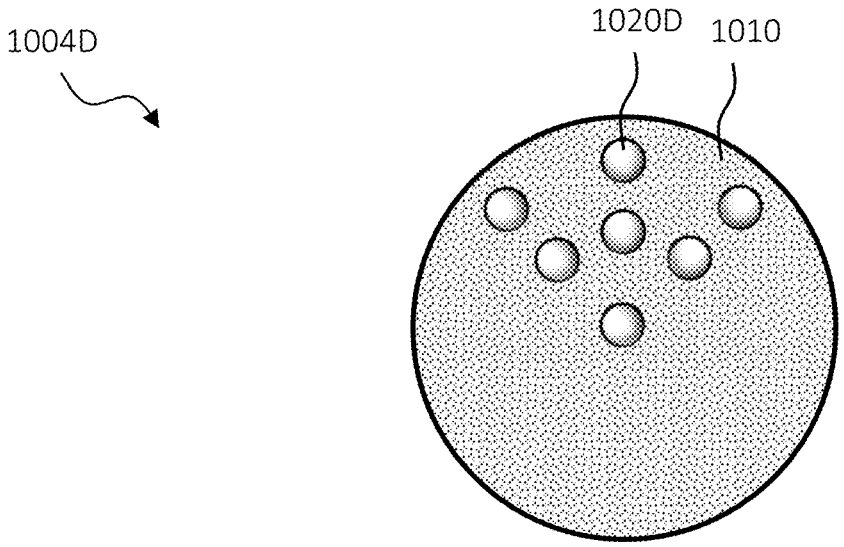

Turning now to FIG. 10D, illustrated is an alternative embodiment of a float 1004D designed, manufactured, and operated according to another embodiment of the disclosure. The float 1004D is similar in many respects to the float 1004C of FIG. 10C. Accordingly, like reference numbers have been used to indicate similar, if not identical, features. The float 1004D differs, for the most part, from the float 1004C in that the plurality of smaller hollow ceramic shells 1020D are equally spaced, but are concentrated together to alter the center of gravity of the float 1004D. For example, wherein a center of gravity of the float 1004C would be substantially at a midpoint of a width and height of the float 1004C, the center of gravity of the float 1004D would be below the midpoint of the height of the float 1004D (e.g., as oriented in FIG. 10D).

Figure 10E:
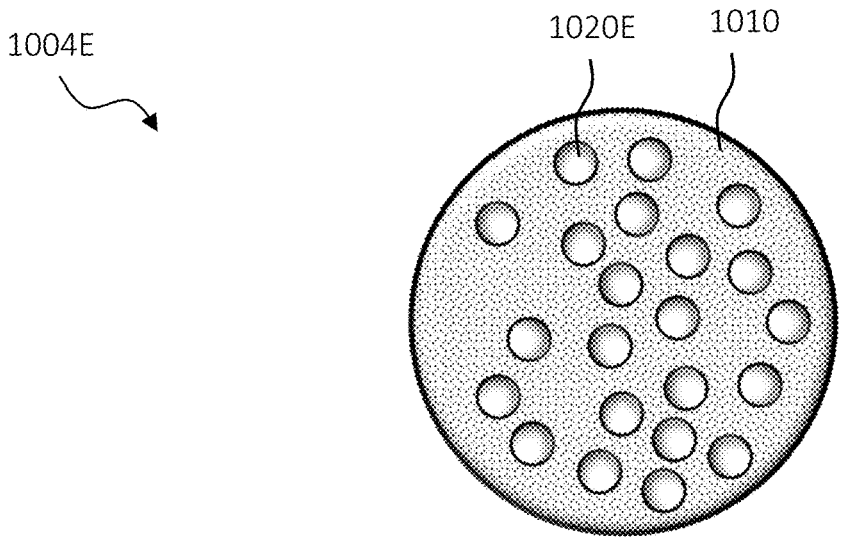

Turning now to FIG. 10E, illustrated is an alternative embodiment of a float 1004E designed, manufactured, and operated according to another embodiment of the disclosure. The float 1004E is similar in many respects to the float 1004C of FIG. 10C. Accordingly, like reference numbers have been used to indicate similar, if not identical, features. The float 1004E differs, for the most part, from the float 1004C in that the smaller hollow ceramic shells 1020E are not equally spaced, and are additionally not formed in rings. For example, in at least one embodiment, the smaller hollow ceramic shells 1020E are randomly spaced.

Figure 10F:
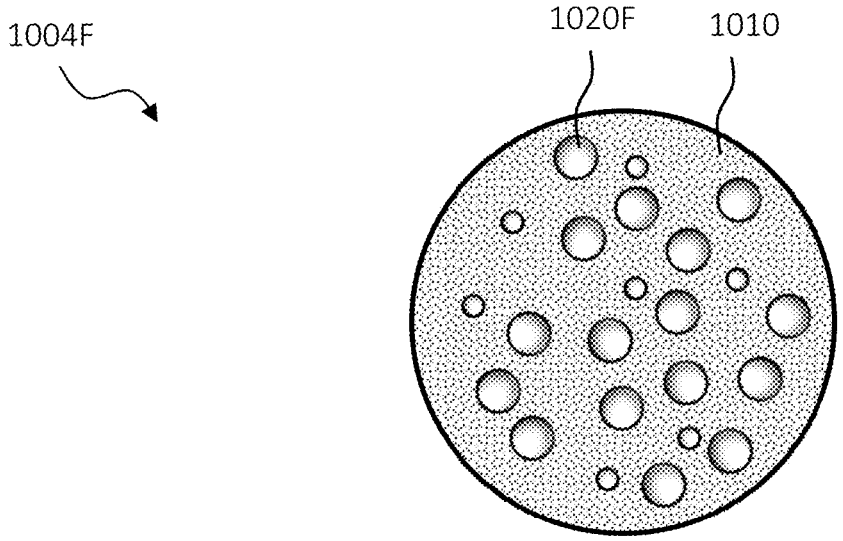

Turning now to FIG. 10F, illustrated is an alternative embodiment of a float 1004F designed, manufactured, and operated according to another embodiment of the disclosure. The float 1004F is similar in many respects to the float 1004E of FIG. 10E. Accordingly, like reference numbers have been used to indicate similar, if not identical, features. The float 1004F differs, for the most part, from the float 1004E in that the smaller hollow ceramic shells 1020F are randomly spaced and have two or more different sizes. In the illustrated embodiment of FIG. 10F, the smaller hollow ceramic shells 1020F have three or more different sizes.

Aspects disclosed herein include:

A. A float for use with a fluid flow control device, the float including a base material having one or more hollow ceramic shells therein, the base material and the one or more hollow ceramic shells creating a net density for the float that is between a first density of a desired fluid and a second density of an undesired fluid, such that the float may control fluid flow through a flow control device when encountering the desired fluid or the undesired fluid.

B. A fluid flow control device, the fluid flow control device including: 1) an inlet port; 2) an outlet port; 3) a float positioned between the inlet port and the outlet port, the float movable between an open position that allows fluid flow through the outlet port and a closed position that restricts fluid flow through the outlet port, the float including a base material having one or more hollow ceramic shells therein, the base material and the one or more hollow ceramic shells creating a net density for the float that is between a first density of a desired fluid and a second density of an undesired fluid, such that the float may control fluid flow through a flow control device when encountering the desired fluid or the undesired fluid.

C. A method for manufacturing a fluid flow control device, the method including: 1) providing a float, the float including a base material having one or more hollow ceramic shells therein, the base material and the one or more hollow ceramic shells creating a net density for the float that is between a first density of a desired fluid and a second density of an undesired fluid, such that the float may control fluid flow through a flow control device when encountering the desired fluid or the undesired fluid; and 2) positioning the float between an inlet port and an outlet port of the flow control device, the float movable between an open position that allows fluid flow through the outlet port and a closed position that restricts fluid flow through the outlet port.

D. A well system, the well system including: 1) a wellbore formed through a subterranean formation; 2) a tubing string positioned within the wellbore; 3) a fluid flow control device coupled to the tubing string, the fluid flow control device including: a) an inlet port operable to receive fluid from the subterranean formation; b) an outlet port operable to pass the fluid to the tubing string; and c) a float positioned between the inlet port and the outlet port, the float movable between an open position that allows fluid flow through the outlet port to the tubing string and a closed position that restricts fluid flow through the outlet port to the tubing string, the float including a base material having one or more hollow ceramic shells therein, the base material and the one or more hollow ceramic shells creating a net density for the float that is between a first density of a desired fluid and a second density of an undesired fluid, such that the float may control fluid flow through the flow control device when encountering the desired fluid or the undesired fluid.

Aspects A, B, and C may have one or more of the following additional elements in combination: Element 1: wherein the base material and the one or more hollow ceramic shells create the net density for the float that is above the first density of the desired fluid and below the second density of the undesired fluid. Element 2: wherein the base material is a polymer base material having the one or more hollow ceramic shells therein. Element 3: wherein the base material has four or more substantially equally spaced hollow ceramic shells. Element 4: wherein the base material has four or more gradiently spaced hollow ceramic shells positioned to alter a center of gravity of the float. Element 5: wherein the base material has four or more substantially equally sized hollow ceramic shells. Element 6: further including a fluid impermeable exterior surrounding the base material having the one or more hollow ceramic shells therein. Element 7: wherein the fluid impermeable exterior forms a hermetic seal around the base material having one or more hollow ceramic shells therein. Element 8: wherein the float includes a critical density area and a non-critical density area. Element 9: wherein the critical density area includes the base material and the one or more hollow ceramic shells, and the non-critical density area comprises a different base material.

Those skilled in the art to which this application relates will appreciate that other and further additions, deletions, substitutions, and modifications may be made to the described embodiments.

What is claimed is:

1. A fluid flow control device, comprising:

an inlet port;

an outlet port;

a float positioned between the inlet port and the outlet port, the float movable between an open position that allows fluid flow through the outlet port and a closed position that restricts fluid flow through the outlet port, the float including:

a base material having one or more hollow ceramic shells therein, the base material and the one or more hollow ceramic shells creating a net density for the float that is between a first density of a desired fluid and a second density of an undesired fluid, such that the float may control fluid flow through the flow control device when encountering the desired fluid or the undesired fluid.

2. The fluid flow control device as recited in claim 1, wherein the base material and the one or more hollow ceramic shells create the net density for the float that is above the first density of the desired fluid and below the second density of the undesired fluid.

3. The fluid flow control device as recited in claim 1, wherein the base material is a polymer base material having the one or more hollow ceramic shells therein.

4. The fluid flow control device as recited in claim 3, wherein the base material has four or more substantially equally spaced hollow ceramic shells.

5. The fluid flow control device as recited in claim 3, wherein the base material has four or more gradiently spaced hollow ceramic shells positioned to alter a center of gravity of the float.

6. The fluid flow control device as recited in claim 3, wherein the base material has four or more substantially equally sized hollow ceramic shells.

7. The fluid flow control device as recited in claim 1, further including a fluid impermeable exterior surrounding the base material having the one or more hollow ceramic shells therein.

8. The fluid flow control device as recited in claim 7, wherein the fluid impermeable exterior forms a hermetic seal around the base material having one or more hollow ceramic shells therein.

9. The fluid flow control device as recited in claim 1, wherein the float includes a critical density area and a non-critical density area.

10. The fluid flow control device as recited in claim 9, wherein the critical density area includes the base material and the one or more hollow ceramic shells, and the non-critical density area comprises a different base material.

11. A method for manufacturing a fluid flow control device, comprising:

providing a float, the float including:

a base material having one or more hollow ceramic shells therein, the base material and the one or more hollow ceramic shells creating a net density for the float that is between a first density of a desired fluid and a second density of an undesired fluid, such that the float may control fluid flow through a flow control device when encountering the desired fluid or the undesired fluid; and positioning the float between an inlet port and an outlet port of the flow control device, the float movable between an open position that allows fluid flow through the outlet port and a closed position that restricts fluid flow through the outlet port.

12. A well system, comprising:

a wellbore formed through a subterranean formation;

a tubing string positioned within the wellbore;

a fluid flow control device coupled to the tubing string, the fluid flow control device including:

an inlet port operable to receive fluid from the subterranean formation;

an outlet port operable to pass the fluid to the tubing string; and a float positioned between the inlet port and the outlet port, the float movable between an open position that allows fluid flow through the outlet port to the tubing string and a closed position that restricts fluid flow through the outlet port to the tubing string, the float including:

a base material having one or more hollow ceramic shells therein, the base material and the one or more hollow ceramic shells creating a net density for the float that is between a first density of a desired fluid and a second density of an undesired fluid, such that the float may control fluid flow through the flow control device when encountering the desired fluid or the undesired fluid.

* * * * *